US009147971B2

(12) United States Patent
Osada et al.

(10) Patent No.: US 9,147,971 B2
(45) Date of Patent: Sep. 29, 2015

(54) ELECTRICAL CONNECTOR AND SQUIB CONNECTION DEVICE

(71) Applicant: J.S.T. Mfg. Co., Ltd., Osaka (JP)

(72) Inventors: Tsuyoshi Osada, Yokohama (JP); Hiroyuki Matsumoto, Yokohama (JP); Munetaka Yasuda, Yokohama (JP)

(73) Assignee: J.S.T. MFG. CO., LTD., Osaka (JP)

( * ) Notice: Subject to any disclaimer, the term of this patent is extended or adjusted under 35 U.S.C. 154(b) by 0 days.

(21) Appl. No.: 14/317,093

(22) Filed: Jun. 27, 2014

(65) Prior Publication Data

US 2015/0004828 A1 Jan. 1, 2015

(30) Foreign Application Priority Data

Jul. 1, 2013 (JP) ..... 2013-138466

(51) Int. Cl.

*H01R 13/64* (2006.01)
*H01R 13/639* (2006.01)
*H01R 13/641* (2006.01)
*H01R 13/627* (2006.01)

(52) U.S. Cl.

CPC ..... *H01R 13/639* (2013.01); *H01R 13/641* (2013.01); *H01R 13/6273* (2013.01)

(58) Field of Classification Search

CPC ..... H01R 13/6273; H01R 13/641
See application file for complete search history.

(56) References Cited

U.S. PATENT DOCUMENTS 5,586,902 A * 12/1996 Hopf et al. ..... 439/352
5,616,045 A * 4/1997 Gauker ..... 439/352
5,688,141 A * 11/1997 Dullin ..... 439/352
5,746,618 A * 5/1998 Gauker ..... 439/352
5,924,885 A * 7/1999 Pacher ..... 439/352
6,319,042 B2 * 11/2001 Hirschmann ..... 439/352
6,419,510 B2 * 7/2002 Shiraki et al. ..... 439/188
6,435,894 B2 * 8/2002 Little et al. ..... 439/352
6,676,452 B2 * 1/2004 Bolen et al. ..... 439/743

(Continued)

FOREIGN PATENT DOCUMENTS

EP 0 999 615 A1 5/2000
EP 2 026 421 A1 2/2009

(Continued)

OTHER PUBLICATIONS

Extended European Search Report dated Oct. 30, 2014 in the corresponding European patent application No. 14175080.2-1801.

*Primary Examiner* — Ross Gushi
(74) *Attorney, Agent, or Firm* — Kratz, Quintos & Hanson, LLP

(57) ABSTRACT

In an electrical connector, in a state in which an abutting portion of a support is abutted against a receiving face of a retainer or an inflator housing, if the connector housing is pressed toward the mating side and then released before being inserted into the retainer to a predetermined depth, then the connector housing is pressed back in the counter mating direction due to restoring force generated in the support. If the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and electrical terminals become connected to squib terminals. Also, a squib connection device includes this electrical connector.

9 Claims, 20 Drawing Sheets

(56) References Cited

U.S. PATENT DOCUMENTS

| | | | | |
|---|---|---|---|---|
| 6,739,913 | B2 * | 5/2004 | Hayashi | 439/620.05 |
| 6,780,036 | B2 * | 8/2004 | Osada | 439/188 |
| 6,811,424 | B2 * | 11/2004 | Brown et al. | 439/352 |
| 6,910,902 | B2 * | 6/2005 | Osada | 439/188 |
| 6,918,781 | B2 * | 7/2005 | Annecke | 439/350 |
| 6,945,801 | B2 * | 9/2005 | Brown | 439/188 |
| 6,976,878 | B2 * | 12/2005 | Shindo | 439/620.01 |
| 7,004,778 | B2 * | 2/2006 | Barker et al. | 439/352 |
| 7,052,324 | B2 * | 5/2006 | Miksche et al. | 439/620.01 |
| 7,121,867 | B2 * | 10/2006 | Annecke | 439/352 |
| 7,131,854 | B1 * | 11/2006 | Pavlovic et al. | 439/352 |
| 7,147,503 | B2 * | 12/2006 | Shindo | 439/354 |
| 7,189,096 | B2 * | 3/2007 | Miksche et al. | 439/352 |
| 7,189,102 | B2 * | 3/2007 | Ermert et al. | 439/459 |
| 7,229,305 | B2 * | 6/2007 | Hirschmann | 439/352 |
| 7,247,039 | B2 * | 7/2007 | Annecke et al. | 439/188 |
| 7,249,960 | B2 * | 7/2007 | Annecke et al. | 439/188 |
| 7,306,474 | B1 * | 12/2007 | Brown et al. | 439/352 |
| 7,344,403 | B2 * | 3/2008 | Major et al. | 439/352 |
| 7,396,253 | B2 * | 7/2008 | Nakamura | 439/489 |
| 7,458,852 | B2 * | 12/2008 | Gunreben | 439/596 |
| 7,530,861 | B2 * | 5/2009 | Nakamura | 439/854 |
| 7,547,232 | B2 * | 6/2009 | Johannes et al. | 439/620.07 |
| 7,559,783 | B2 * | 7/2009 | Ripper et al. | 439/188 |
| 7,578,694 | B2 * | 8/2009 | Takahashi et al. | 439/352 |
| 7,670,164 | B2 * | 3/2010 | Shiga | 439/278 |
| 7,833,044 | B2 * | 11/2010 | Bouchan et al. | 439/352 |
| 7,967,625 | B2 * | 6/2011 | Fujiwara et al. | 439/271 |
| 7,997,940 | B2 * | 8/2011 | Regnier | 439/676 |
| 8,043,105 | B2 * | 10/2011 | Schmidt et al. | 439/271 |
| 8,257,108 | B2 * | 9/2012 | Brown | 439/378 |
| 8,529,278 | B2 * | 9/2013 | Shiga | 439/272 |
| 8,545,262 | B2 * | 10/2013 | Schmidt | 439/507 |
| 8,647,140 | B2 * | 2/2014 | Annecke | 439/352 |
| 8,647,150 | B2 * | 2/2014 | Fujiwara et al. | 439/587 |
| 8,939,799 | B2 * | 1/2015 | Watanabe et al. | 439/686 |
| 8,968,021 | B1 * | 3/2015 | Kennedy et al. | 439/352 |
| 9,017,090 | B2 * | 4/2015 | Matsumoto et al. | 439/350 |
| 2004/0002248 | A1 * | 1/2004 | Glick et al. | 439/352 |
| 2004/0002253 | A1 * | 1/2004 | Pavlovic et al. | 439/489 |
| 2004/0005806 | A1 * | 1/2004 | Annecke | 439/358 |
| 2004/0192098 | A1 * | 9/2004 | Pavlovic et al. | 439/350 |
| 2005/0009390 | A1 * | 1/2005 | Barker et al. | 439/188 |
| 2006/0183366 | A1 | 8/2006 | Ripper et al. | |
| 2008/0064250 | A1 * | 3/2008 | Lee et al. | 439/352 |
| 2012/0112762 | A1 * | 5/2012 | Odorfer et al. | 324/538 |
| 2013/0072054 | A1 * | 3/2013 | Hotea et al. | 439/460 |
| 2013/0252455 | A1 * | 9/2013 | Gunreben et al. | 439/370 |
| 2014/0045361 | A1 * | 2/2014 | Gunreben et al. | 439/345 |
| 2014/0106601 | A1 * | 4/2014 | Matsumoto et al. | 439/352 |
| 2014/0154911 | A1 | 6/2014 | Matsumoto et al. | |
| 2015/0004828 | A1 * | 1/2015 | Osada et al. | 439/357 |
| 2015/0037996 | A1 * | 2/2015 | Chen | 439/345 |
| 2015/0056841 | A1 * | 2/2015 | Siwek et al. | 439/352 |
| 2015/0111409 | A1 * | 4/2015 | Miyakawa et al. | 439/357 |

FOREIGN PATENT DOCUMENTS

| | | | |
|---|---|---|---|
| GB | 2 355 867 | A | 5/2001 |
| JP | 2012-22990 | A | 2/2012 |
| JP | 2012-22990 | A1 | 2/2012 |
| WO | 2012/055719 | A1 | 5/2012 |
| WO | 2012/143570 | A1 | 10/2012 |

* cited by examiner

ELECTRICAL CONNECTOR AND SQUIB CONNECTION DEVICE

BACKGROUND OF THE INVENTION

1. Field of the Invention

The present invention belongs to the technical field of electrical connectors, relating to an electrical connector for connection with a partner device that has an inflator housing, a squib, and a retainer. Furthermore, the present invention relates to a squib connection device that includes the partner device and the electrical connector.

2. Description of the Related Art

JP-2012-22990-A discloses a connector that can suppress deformation of a locking arm that presses a slider assembled to a housing via a biasing means. This connector includes an initiator and a housing. A shunt of the initiator is provided with the locking arm. A slider is assembled, via a spring, to a terminal housing portion provided in a housing body of the housing. When mounting the housing to the initiator, the locking arm rides up the housing, then comes into contact with an arm reception portion of the slider and presses the slider in resistance to the biasing of the spring. Then, the locking arm undergoes restoration so as to become locked with the terminal housing portion. The end face of the slider that comes into contact with the locking arm is tapered so as to guide the locking arm in the restoring direction of the locking arm.

SUMMARY OF THE INVENTION

With the connector of this patent document, if the force for moving the housing rearward is removed before the mating of the housing and the initiator, the slider will move rearward due to the biasing force of the spring, the locking arm will be pressed rearward by the tapered portion, and the housing and initiator will become separated from each other (see paragraph 0021 of the patent document). This prevents incomplete mating of the housing and the initiator.

However, the shunt of the connector of this patent document has a complex shape due to the locking arm being provided in the shunt. Also, as the housing is mated to the initiator, the spring is not compressed until the mated length reaches a predetermined length at which the tapered portion of the reception portion of the slider comes into contact with the spring. Before the mated length reaches the predetermined length, elastic restoring force is not generated by the spring. Therefore, force for separating the housing and the initiator is not exerted, and an operational error can possibly occur in which the mating operation is ended regardless of the fact that the mating of the housing and the initiator is incomplete. Moreover, the pins will have already come into contact with the terminals before the mated length has reached the predetermined length (see FIGS. 4 and 5 of the patent document). The pins therefore conduct electricity to the terminals regardless of the fact that the mating of the housing and the initiator is incomplete. Of course, the two pins are shorted by shorting fittings that are fitted into housing recession portions of the shunt, and therefore even if the mating of the housing and the initiator is incomplete, current will not flow through the two pins as long as the shorting fittings are in elastic contact with the two pins. However, if the shorting fittings are not provided, current will flow through the two pins due to the pins conducting electricity to the terminals regardless of the fact that the mating of the housing and the initiator is incomplete.

An object of the present invention is to provide an electrical connector and a squib connection device that can solve the above-described problems.

An electrical connector according to one aspect of the present invention is an electrical connector for mating to a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket, the electrical connector including:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, wherein in a state in which the abutting portion of the support is abutted against a receiving face of the retainer or the inflator housing whose edge descends toward the counter mating side, if the connector housing is pressed toward the mating side and then released before being inserted into the retainer to a predetermined depth, the connector housing is pressed back in the counter mating direction due to restoring force generated in the support, and if the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

In a state in which the abutting portion of the support is abutted against the receiving face of the retainer or the inflator housing, if the connector housing is pressed toward the mating side and then released before being inserted into the retainer to the predetermined depth, the connector housing is pressed back in the counter mating direction due to the restoring force generated in the support. In the state where the abutting portion of the support is abutted against the receiving face of the retainer or the inflator housing, if the connector housing is pressed toward the mating side and inserted into the retainer to the predetermined depth, the abutting portion is displaced in the abutment cancelation direction so as to separate from the receiving face. Thus, the connector housing is inserted into the retainer to the predetermined depth or more and mates with the retainer, and the electrical terminals come into contact with the squib terminals. Accordingly, if the connector housing is at a position of being pushed back in the counter mating direction relative to the retainer, the two are not mated. On the other hand, if the connector housing is at a position of having been inserted into the retainer to the predetermined depth or more, the two are mated. Moreover, the connector housing is never located at a position between the above two positions where it is not subjected to pressing force. For this reason, whether or not the electrical connector is mated to the retainer can be checked based on the position of the connector housing relative to the retainer, thus easily preventing incomplete mating of the electrical connector to the retainer. Also, the retainer has a comparatively simple structure since the retainer does not have members corresponding to the locking arms of the above-described patent document.

When the electrical connector is to be mated to the retainer, the connector housing need only be pressed toward the mating side. For this reason, the operator cannot select from various patterns of operational content, such as first pressing the connector housing toward the mating side and then pressing an accessory member, such as a lock member, toward the mating side, first pressing the accessory member toward the mating side and then pressing the connector housing toward the mating side, or pressing both at the same time. This results in little risk of incomplete mating due to differences in operational content.

A squib connection device according to one aspect of the present invention is a squib connection device including: a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector for mating to the partner device, wherein the electrical connector includes:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, and in a state in which the abutting portion of the support is abutted against a receiving face of the retainer or the inflator housing whose edge descends toward the counter mating side, if the connector housing is pressed toward the mating side and then released before being inserted into the retainer to a predetermined depth, the connector housing is pressed back in the counter mating direction due to restoring force generated in the support, and if the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

In a state in which the abutting portion of the support is abutted against the receiving face of the retainer or the inflator housing, if the connector housing is pressed toward the mating side and then released before being inserted into the retainer to the predetermined depth, the connector housing is pressed back in the counter mating direction due to the restoring force generated in the support. In the state where the abutting portion of the support is abutted against the receiving face of the retainer or the inflator housing, if the connector housing is pressed toward the mating side and inserted into the retainer to the predetermined depth, the abutting portion is displaced in the abutment cancelation direction so as to separate from the receiving face. Thus, the connector housing is inserted into the retainer to the predetermined depth or more and mates with the retainer, and the electrical terminals come into contact with the squib terminals. Accordingly, if the connector housing is at a position of being pushed back in the counter mating direction relative to the retainer, the two are not mated. If the connector housing is at a position of having been inserted into the retainer to the predetermined depth or more, the two are mated. Moreover, the connector housing is never located at a position between the above two positions where it is not subjected to pressing force. For this reason, whether or not the electrical connector is mated to the retainer can be checked based on the position of the connector housing relative to the retainer, thus easily preventing incomplete mating of the electrical connector to the retainer. Also, the retainer has a comparatively simple structure since the retainer does not have members corresponding to the locking arms of the above-described patent document.

When the electrical connector is to be mated to the retainer, the connector housing need only be pressed toward the mating side. For this reason, the operator cannot select from various patterns of operational content, such as first pressing the connector housing toward the mating side and then pressing an accessory member, such as a lock member, toward the mating side, first pressing the accessory member toward the mating side and then pressing the connector housing toward the mating side, or pressing both at the same time. This results in little risk of incomplete mating due to differences in operational content.

DETAILED DESCRIPTION OF THE INVENTION

Figure 1:
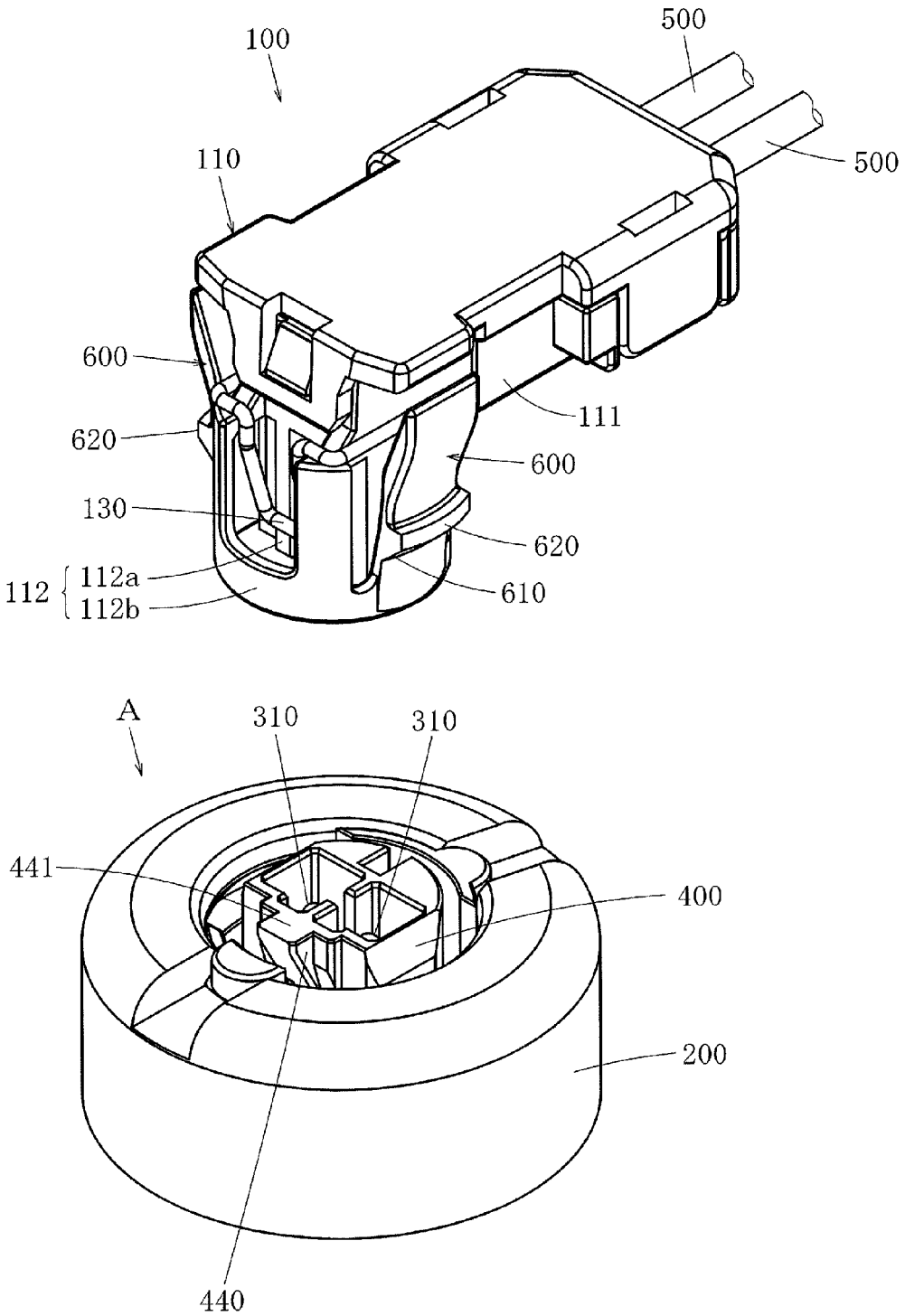
FIG. 1 is a perspective view of an embodiment of an electrical connector and a squib connection device of the present invention.

Embodiments of the present invention will be described below. FIGS. 1 to 17 show an embodiment of an electrical connector and a squib connection device including the electrical connector according to the present invention. The electrical connector and the squib connection device are elements constituting an inflator, which is a device for inflating an airbag. As shown in FIG. 1, the squib connection device includes a partner device A and an electrical connector 100 for mating with the partner device A. The partner device A has an inflator housing 200, a squib 300, and a retainer 400. In both the electrical connector 100 and the partner device A that are to be mated to each other, the mating side refers to the side on which the one is to be mated to the other, and the mating direction refers to the direction in which the one faces the other when the electrical connector 100 and the partner device A are arranged such that their mating sides oppose each other. The counter mating side is the side opposite to the mating side, and the counter mating direction is the direction opposite to the mating direction. Hereinafter, when the mating side, the mating direction, the counter mating side, or the counter mating direction relative to a member or portion is simply referred to, if that member or portion is provided in the electrical connector 100, then that side or direction refers to the mating side, the mating direction, the counter mating side, or the counter mating direction of the electrical connector 100; if that member or portion is provided in the partner device A, then that side or direction refers to the mating side, the mating direction, the counter mating side, or the counter mating direction of the partner device A. Accordingly, when FIG. 7 is oriented such that the reference signs can be read properly, the mating side of the electrical connector 100 refers to the lower side of the electrical connector 100 in the figure, the mating direction refers to the downward direction of the electrical connector 100 in the figure, the counter mating side refers to the upper side of the electrical connector 100 in the figure, and the counter mating direction refers to the upward direction of the electrical connector 100 in the figure. Also, in the same figure, the mating side of the partner device A refers to the upper side of the partner device A in the figure, the mating direction refers the upward direction of the partner device A in the figure, the counter mating side refers to the lower side of the partner device A in the figure, and the counter mating direction refers to the downward direction of the partner device A in the figure.

The inflator housing 200 is formed from an aluminum alloy, and it may be formed from a conductive material in this way, or may be formed from an insulating material or another material, for example. As shown in FIGS. 1 and 4 to 17, the inflator housing 200 is provided with a socket 210 that is recessed toward the counter mating side from the surface on the mating side. The socket 210 is formed such that the interior space is shaped as a circular column, but it may be formed such that the interior space is shaped as a prism or has another shape.

As shown in FIGS. 1, 4, 7, 8, and the like, a pair of squib terminals 310 that rise up toward the mating side are provided on the mating side of the squib 300. These squib terminals 310 are formed from a conductive material and are bar-shaped, but they may be tube-shaped, plate-shaped, or have another shape. The squib terminals 310 are also sometimes called "pins". When current is applied to the squib 300 via the pair of squib terminals 310, the squib 300 receives the electrical energy and generates heat. Since the inflator housing 200 is formed from a conductive material, an insulating member is provided so as to surround the squib terminals 310, thus insulating the squib terminals 310 and the inflator housing 200 from each other. Depending on how grounding is performed, for example, the squib terminals can be monopolar or have three or more poles. The squib 300 is provided on the counter mating side of the inflator housing 200 such that the squib terminals 310 rise up toward the mating side from the bottom portion of the socket 210. An igniting agent and a gas-forming agent are arranged so as to surround the squib 300. A compressed airbag is accommodated in the counter mating side of the inflator housing 200. Accordingly, when the squib 300 receives electrical energy and generates heat, the igniting agent ignites, the gas-forming agent thus forms gas, and that gas deploys the airbag.

The retainer 400 is formed from a synthetic resin, and it may be formed from an insulating material in this way, or it may be formed from a conductive material or another material, for example in the case of employing a configuration in which it is insulated from the squib terminals 310 or later-described electrical terminals 120. As shown in FIGS. 1, 4, 7, 8, and the like, the retainer 400 is formed such that its external shape corresponds to the interior space of the socket 210, and therefore in the case of this embodiment, the outer periphery of a horizontal cross-section of the retainer 400 is substantially circular. However, the outer periphery of the horizontal cross-section of the retainer may be polygonal or have another shape as long as it can fit in the interior space of the socket 210. The retainer 400 is provided with a cavity that penetrates in the mating direction and allows the introduction of the squib terminals 310 from the counter mating side. The retainer 400 is attached to the socket 210. In order to ensure force for engaging the retainer 400 and the socket 210, the retainer 400 is provided with attachment protruding portions 410. The attachment protruding portions 410 fit into a groove 212 provided in the socket 210. Each attachment protruding portion 410 is provided so as to project outward in the periphery of the retainer 400. The outer side is, in a view from the mating direction, the side that is away from the central portion of the retainer 400, inner side is the side that is opposite to the outer side. The groove 212 is provided so as to be recessed outward in a wall 211 that constitutes the socket 210 of the inflator housing 200. When viewing the retainer 400 from the mating direction, the outer side of the socket 210 is the side that is away from the central portion of the socket 210, and the inner side is the side that is opposite to the outer side. When the retainer 400 is pressed into the socket 210, the attachment protruding portions 410 elastically deform inward due to being pressed by the wall 211, thus allowing the retainer 400 to be inserted into the socket 210. When the attachment protruding portions 410 reach the position of the groove 212, the attachment protruding portions 410 return to their original state and fit into the groove 212, and the retainer 400 and the socket 210 are thus engaged with each other. A configuration is possible in which, for example, in place of the attachment protruding portions, attachment arms that extend in the mating direction are provided in the periphery of the retainer, one end of each of them being fixed to the retainer, and the other end being provided with a projection that projects outward. The retainer and the socket are mated by fitting the projections into the groove using elastic deformation of the attachment arms.

Figure 4:
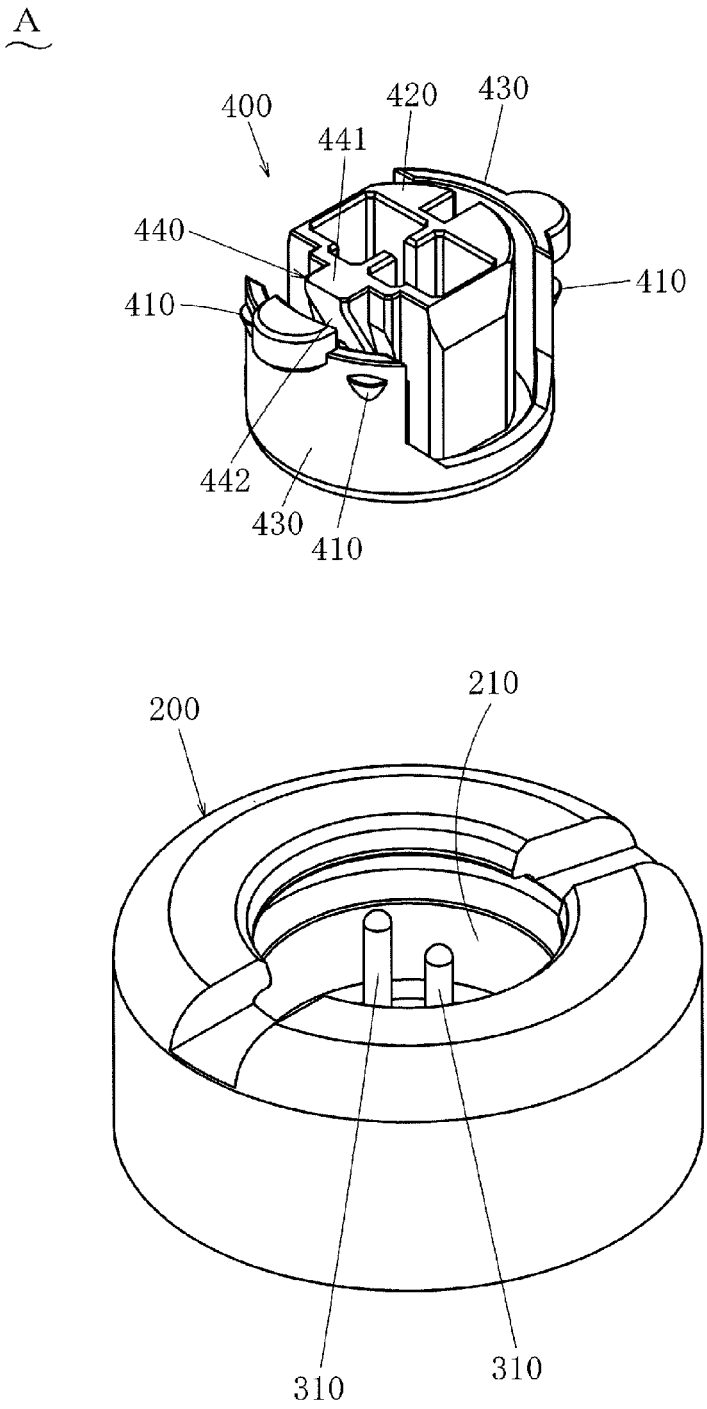
FIG. 4 is an exploded perspective view of the squib connection device of the embodiment.
Figure 5:
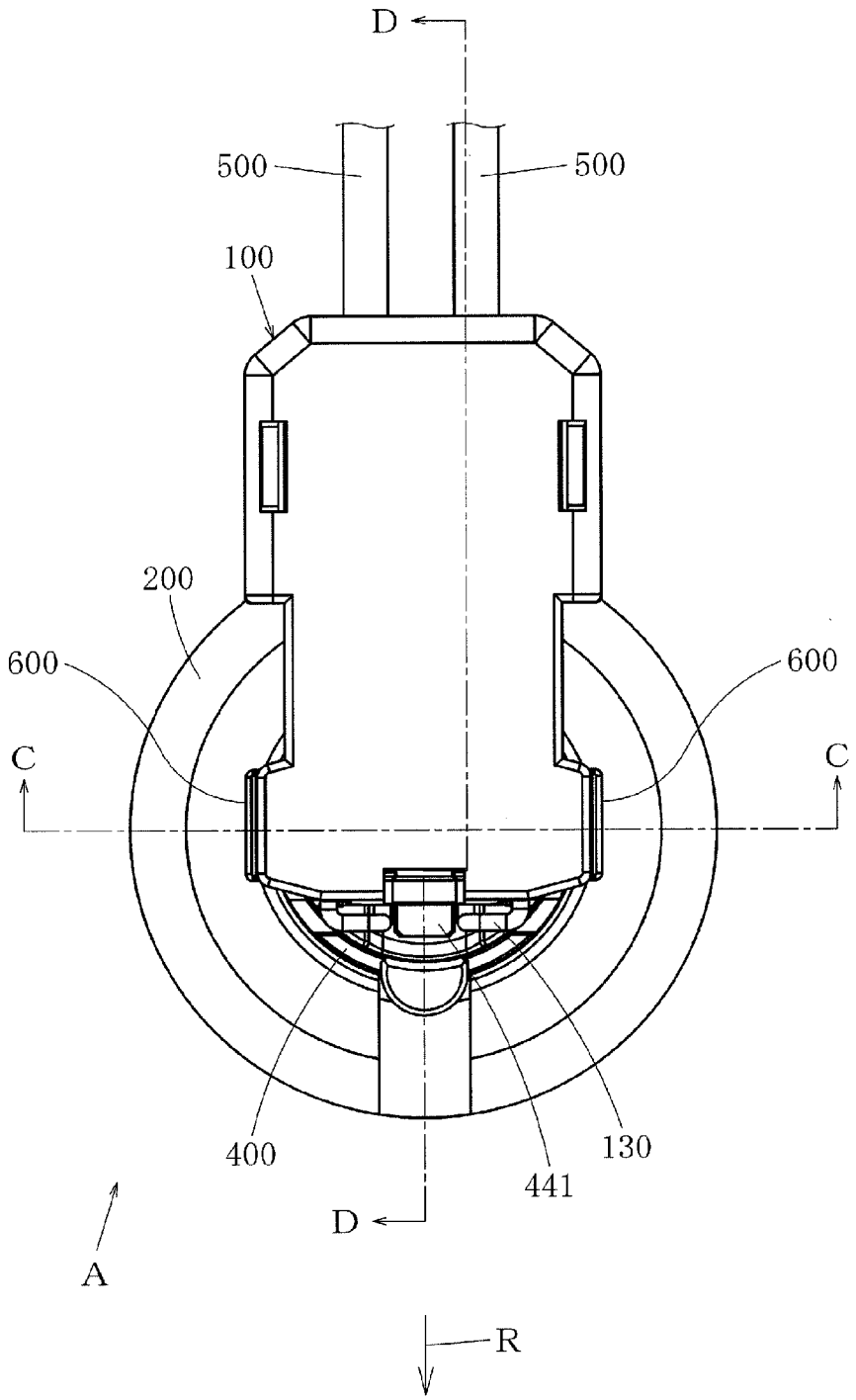
FIG. 5 is a plan view of the squib connection device of the embodiment and the electrical connector being mated thereto as viewed along the mating direction.
Figure 8:
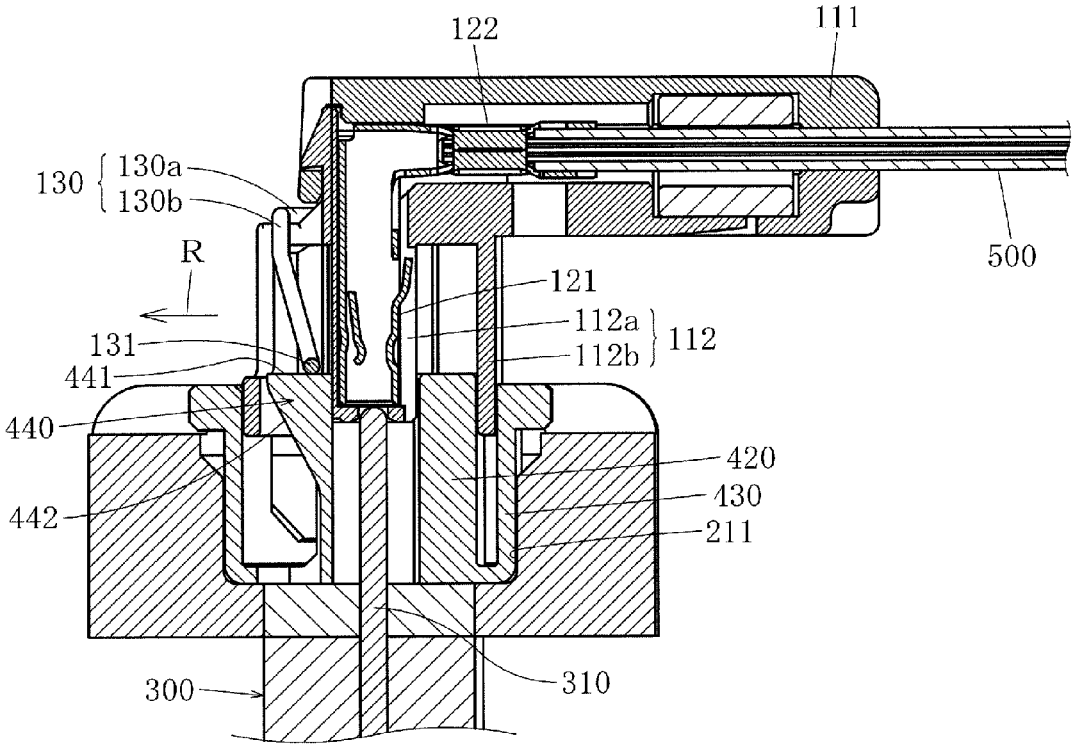
FIG. 8 is a cross-sectional view of the squib connection device and the electrical connector of the embodiment in the state shown in FIG. 6, taken along line D-D in FIG. 5.

As shown in FIGS. 4, 8, and the like, the retainer 400 is provided with a receiving face 441 whose edge descends toward the counter mating side. In place of or in addition to this, the inflator housing 200 may be provided with a receiving face whose edge descends toward the counter mating side. In the case of this embodiment, the retainer 400 is provided with a corner portion 440 formed so as to be L-shaped when viewed from a direction orthogonal to the mating direction. This corner portion 440 is provided on the later-described retainer first tube-shaped portion 420, but may be provided on another portion of the retainer 400. The corner portion may be provided on the socket of the inflator housing. In this case, the corner portion is provided so as to extend from the face of the socket 210 on the mating side to the wall 211. The corner portion 440 includes the receiving face 441 that faces the mating side and a side face 442 that extends toward the counter mating side from the edge of the receiving face 441 on an abutment cancelation direction R side. The abutment cancelation direction R is a direction orthogonal to the mating direction and is the direction shown by the leftward-facing arrow in FIG. 8. However, the abutment cancelation direction is not limited to being a direction orthogonal to the mating direction and need only be a direction that intersects the mating direction. The side face 442 is provided so as to be tilted so as to approach the abutment cancelation direction R as it extends in the mating direction. However, the side face may face another direction and may face the abutment cancelation direction R without being tilted.

Figure 3:
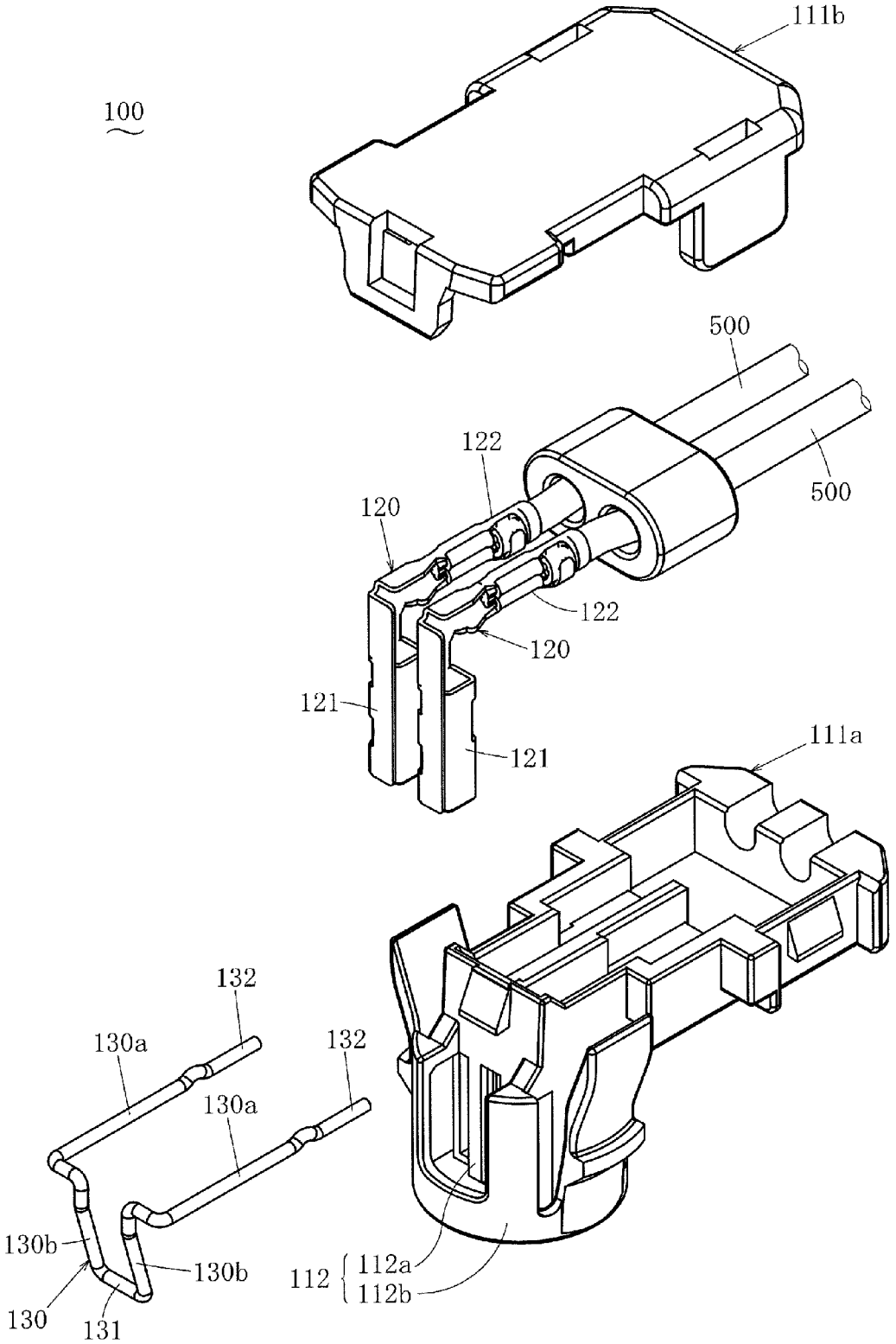
FIG. 3 is an exploded perspective view of the electrical connector of the embodiment.

As shown in FIG. 3, the electrical connector 100 includes a connector housing 110, electrical terminals 120, and a support 130.

Figure 2:
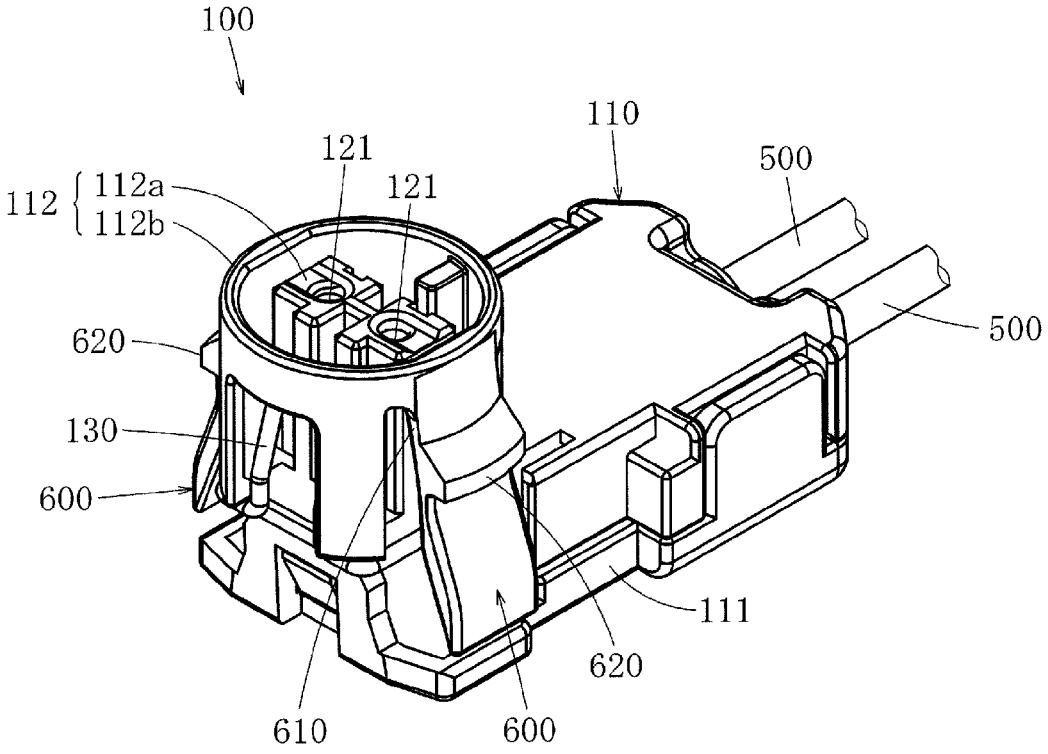
FIG. 2 is a perspective view of the electrical connector of the embodiment as viewed from the opposite side.

The connector housing 110 is formed from a synthetic resin, and it may be formed from an insulating material in this way, or it may be formed from a conductive material or another material, for example in the case of employing a configuration in which it is insulated from the electrical terminals 120 or the squib terminals 310. As shown in FIGS. 1 to 3 and the like, the connector housing 110 includes a housing body 111 and a mating portion 112 that is provided on the mating side of the housing body 111 and is for mating with the retainer 400. The housing body 111 extends in a direction orthogonal to the mating direction, and the mating portion 112 extends in the mating direction from one end side of the housing body 111. However, the shapes of the housing body and the mating portion are not intended to be limited to this. The housing body may, for example, be shaped as a cuboid or the like that does not have a lengthwise direction, or may be formed such that the lengthwise direction of the housing body forms an angle greater than 0 degrees and less than 180 degrees relative to the mating direction. Also, the mating portion need only be provided on the mating side of the housing body, and may be provided at any position on the face of the housing body that faces the mating direction. The mating portion 112 and the retainer 400 are mated to each other by a protruding portion provided on one of them being inserted into a recessed portion provided on the other one, and are detached from each other by pulling the protruding portion out of the recessed portion. As one variation, it is possible for the mating portion and the retainer to be fixedly mated to each other, that is to say, permanently mated. In the case of this embodiment, the mating portion 112 is provided with housing protruding portions 112*a* as protruding portions, the retainer 400 is correspondingly provided with a retainer first tube-shaped portion 420, which is tube-shaped having a recessed portion formed therein, and the above mating is performed by the housing protruding portions 112*a* being placed inside the recessed portion inside the retainer first tube-shaped portion 420. Conversely, a configuration is possible in which, for example, the retainer is provided with retainer protruding portions as protruding portions, the mating portion is correspondingly provided with a housing tube-shaped portion, which is tube-shaped having a recessed portion formed therein, and the above mating is performed by the retainer protruding portions being placed inside the recessed portion inside the housing tube-shaped portion. In the case of this embodiment, the mating portion 112 is further provided with a tube-shaped housing tube-shaped portion 112*b* outward of the housing protruding portions 112*a*, and the above mating is performed by the housing tube-shaped portion 112*b* being fitted to the outer side of the retainer first tube-shaped portion 420 of the retainer 400. The retainer 400 is provided with a retainer second tube-shaped portion 430, which is tube-shaped having a recessed portion formed therein, outward of the retainer first tube-shaped portion 420, and the above mating is performed by the housing tube-shaped portion 112*b* being placed inside the recessed portion inside the retainer second tube-shaped portion 430. However, it is sufficient that either the mating portion or the retainer is provided with at least one protruding portion, the other one is provided with at least one recessed portion, and thus the mating portion and the retainer are mated or separated. Also, the electrical terminals 120 are arranged inside the housing protruding portions 112*a*, the interior of the retainer first tube-shaped portion 420 serves as the above-described cavity, and the squib terminals 310 are arranged therein. Although the housing body 111 is divided into a first member 111*a* on the mating side and a second member 111*b* on the counter mating side, as shown in FIG. 3, it may be provided as one integrated portion instead of being divided.

As shown in FIGS. 3, 7, 8, and the like, the number of electrical terminals 120 that are provided corresponds to the number of squib terminals 310, but a non-corresponding number can be provided depending on the circuit configuration. In the case of this embodiment, a pair of electrical terminals 120 is provided. The electrical terminals 120 are formed from a conductive material, each include a contact portion 121 and a connection portion 122, and are provided in the connector housing 110. Also, the contact portions 121 are configured so as to come into contact with the squib terminals 310 at least when the mating portion 112 of the connector housing 110 has been mated to the retainer 400. The contact portions 121 may be in contact with the squib terminals 310 even when the mated length is shorter than when the mating portion 112 of the connector housing 110 has been mated with the retainer 400; this configuration is applied in this embodiment. The mating of the mating portion 112 of the connector housing 110 to the retainer 400 refers to the mated length of the mating portion 112 and the retainer 400 reaching a mated length that has been set as the design target, as well as the electrical terminals 120 being in contact with the squib terminals 310, which is the state shown in FIGS. 15 to 17. The electrical terminals 120 are formed from plate-shaped objects, but they may be formed from another mode of material. The contact portions 121 are provided on the mating side of the electrical terminals 120, but they may be provided on, for example, the counter mating side of the electrical terminals or on another portion. Also, the contact portions 121 are configured so as to come into contact with the squib terminal 310 when the mating portion 112 is mated to the retainer 400. Since the squib terminals 310 are formed in the shape of bars, the contact portions 121 of the electrical terminal 120 are formed in the shape of tubes so as to fit around the squib terminals 310. If the squib terminals are formed in the shape of tubes, on the other hand, the contact portions of the electrical terminals may be formed in the shape of bars so as to fit into the squib terminals. The contact portions of the electrical terminals need only be formed in a shape that allows coming into contact with the squib terminals and may be formed in the shape of plates, for example, or have another shape. The connection portions 122 each include a connection structure for connection to a conducting body 500. In the case of this embodiment, the conducting body 500 is an electrical wire that includes a core wire and an insulating coating that coats the core wire, and therefore the connection structure is constituted by a wire barrel and an insulation barrel. The wire barrel includes a crimping part that rises from the plate width direction of the electrical terminal 120 and crimps the portion of the core wire that is exposed from the end of the conducting body 500. The insulation barrel includes a crimping part, that rises from the plate width direction of the electrical terminal 120 on the side far from the contact portion 121 relative to the wire barrel of the electrical terminal 120, and crimps the insulating coating on the end of the conducting body 500. The conducting body 500 includes not only the electrical wire, but also a shielded cable or an element thereof, includes a flat flexible cable such as an FFC (Flexible Flat Cable) or an element thereof, and includes a conducting means that includes another conducting body. Also, the connection structure may be, for example, a structure for insulation displacement of the conducting body, a structure for piercing the conducting body, a structure for soldering the conducting body, or another structure. In the case of this embodiment, the contact portion 121 is mounted inside the mating portion 112, and the connection portion 122 is mounted inside the housing body 111, and therefore the contact portion 121 extends in the mating direction, which is the lengthwise direction of the mating portion 112, and the connection portion 122 extends in a direction orthogonal to the mating direction, which is the lengthwise direction of the housing body 111, thus making the electrical terminal 120 L-shaped. The electrical terminal may be, for example, I-shaped, V-shaped, or have another shape. The contact portion and the connection portion may be provided outside the connector housing. FIG. 18 shows a variation of the electrical connector 100. In the case of this electrical connector 100, another electrical terminal 120' is further provided in addition to the pair of electrical terminals 120. Other aspects of the configuration are similar to the electrical connector of this embodiment. The other electrical terminal 120' includes a contact portion 121' provided on the mating side, and a connection portion (not shown) that has a connection structure for connection with another conducting body 500'. The contact portion 121' protrudes outward from an opening provided in the mating portion 112, and when the mating portion 112 is mated to the retainer 400, the contact portion 121' comes into contact with the wall 211 of the socket 210 and conducts electricity to the inflator housing 200. The other conducting body 500' is an electrical wire configured similarly to the conducting body 500 and includes not only the electrical wire, but also a shielded cable or an element thereof, includes a flat flexible cable such as an FFC or an element thereof, and includes a conducting means that includes another conducting body. The connection portion of the other electrical terminal 120' is configured similarly to the connection portions 122 of the electrical terminals 120 and is connected to the other conducting body 500' in a similar manner to the connection portions 122. Furthermore, there is a variation of the electrical connector 100 in which connection with a shielded cable is performed. In this variation, for example, the signal wire of the shielded cable is connected to the connection portion 122 of the electrical terminal 120 as the conducting body 500, and the outer conducting body of the shielded cable is connected to the connection portion of the other electrical terminal 120' as the other conducting body 500'. There are also modes in which the electrical terminals do not include the connection portion. Among such modes, there is a mode of the electrical terminals in which electrical conduction with the outside is performed in a contactless manner.

The support 130 is configured such that an abutting portion 131, which is displaced relative to the connector housing 110 in the counter mating direction and the abutment cancelation direction R intersecting the mating direction when pressed in the counter mating direction, is provided on the end portion on the mating-side. Restoring force is generated by the displacement of the abutting portion 131. In the case of this embodiment, the support 130 is formed from steel. The support 130 is formed by a bar-shaped member. The support is configured such that at least a portion thereof is flexible so as to generate restoring force upon receiving the above-described pressing force. Accordingly, the entirety of the support may be formed from steel in this way, or from a synthetic resin or another flexible material, and a configuration is possible in which, for example, only a portion of the support is formed from steel, a synthetic resin, another flexible material, or the like, and the other portion is formed from ceramic, another inflexible material, or the like. Also, the support may be provided by assembling or integrating multiple members, for example. The support may be a separate member from the connector housing, as in this embodiment, or the support may be provided integrally with the connector housing. The support may be formed as a member that is bar-shaped, plate-shaped, has another shape, or may have a combination of these shapes. Also, the support 130 is provided on the connector housing 110. Moreover, the abutting portion 131 is provided on the end portion of the support 130 on the mating side. Here, end portions 132 of the support 130 on the side different from the abutting portion 131 side are clamped by the first member 111*a* and the second member 111*b* such that the end portions 132 are fixed to the connector housing 110. Accordingly, the end portions 132 are set as fixed ends such that the support 130 is provided so as to be cantilevered to the connector housing 110. Also, the abutting portion 131 is configured so as to be displaced relative to the connector housing 110 in the counter mating direction and the abutment cancelation direction R intersecting the mating direction when pressed in the counter mating direction, such that restoring force is generated in the support 130 due to the displacement of the abutting portion 131. The end portions 132 of the support may be provided integrally with the connector housing. The support 130 is formed so as to be L-shaped including first portions 130*a* that extend from the end portions 132 in a direction orthogonal to the mating direction, and second portions 130*b* that extend in the mating direction from the end portions of the first portions 130*a* on the side opposite to the end portions 132, and the abutting portion 131 is formed on the end portions of the second portions 130*b* on the mating side. However, the interpretation of the structure of the support is not intended to be limited to this, and the present invention includes variations such as a variation in which the end portions of the support on the mating side are provided with the abutting portion that extends in the mating direction as it extends from the end portions in a direction orthogonal to the mating direction, and the second portions are not provided, for example. Two first portions 130*a* are provided and extend parallel to each other. Two second portions 130*b* are also provided and extend parallel to each other. The gap between the two second portions 130*b* is narrower than the gap between the two first portions 130*a*, and the two second portions 130*b* are provided so as to be positioned between the two first portions 130*a*. The support 130 is formed so as to be symmetrical with respect to a line parallel to the mating direction when viewed from a direction orthogonal to the mating direction. The abutting portion 131 is formed so as to be substantially U-shaped when viewed from the direction orthogonal to the mating direction. However, the structure of the support is not intended to be limited to this, and the present invention includes variations such as a variation in which the support has one first portion or second portion, and the present invention also includes variations such as a variation in which the first portions or the second portions of the support are asymmetrical, and the abutting portion may be formed so as to be bar-shaped, plate-shaped, or have another shape. Also, as shown in FIGS. 8, 11, 14, and 17, the support 130 is provided such that due to having the end portions 132 as the fixed ends and bending like a cantilever relative to the connector housing 110, the abutting portion 131 becomes displaced relative to the connector housing 110 in the counter mating direction and the abutment cancelation direction R orthogonal to the mating direction. Restoring force is generated in the support 130 due to the displacement of the abutting portion 131. In the case of this embodiment, restoring force is generated due to the entirety of the support 130 bending (i.e., undergoing elastic deformation). However, a configuration is possible in which the support is configured by a structural member that is bar-shaped, plate-shaped, or has another shape, and also an elastic member such as a coil spring, that is provided between a pair of the structure members or between the structural member and the connector housing, and the restoring force is generated due to the elasticity of the elastic member or that elasticity and additionally the elasticity of the structural member.

Figure 6:
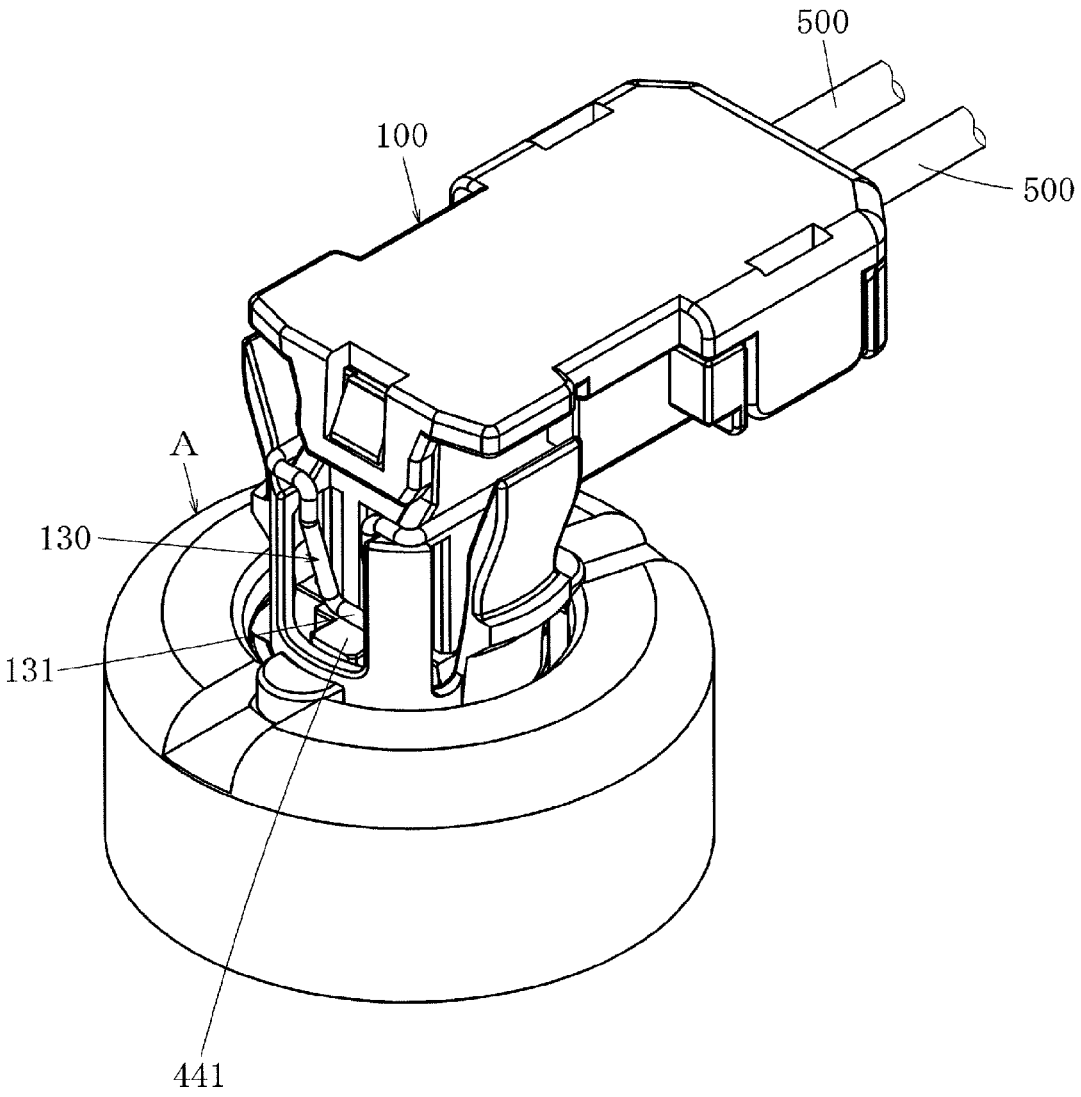
FIG. 6 is a perspective view of the squib connection device of the embodiment and the electrical connector being mated thereto.
Figure 7:
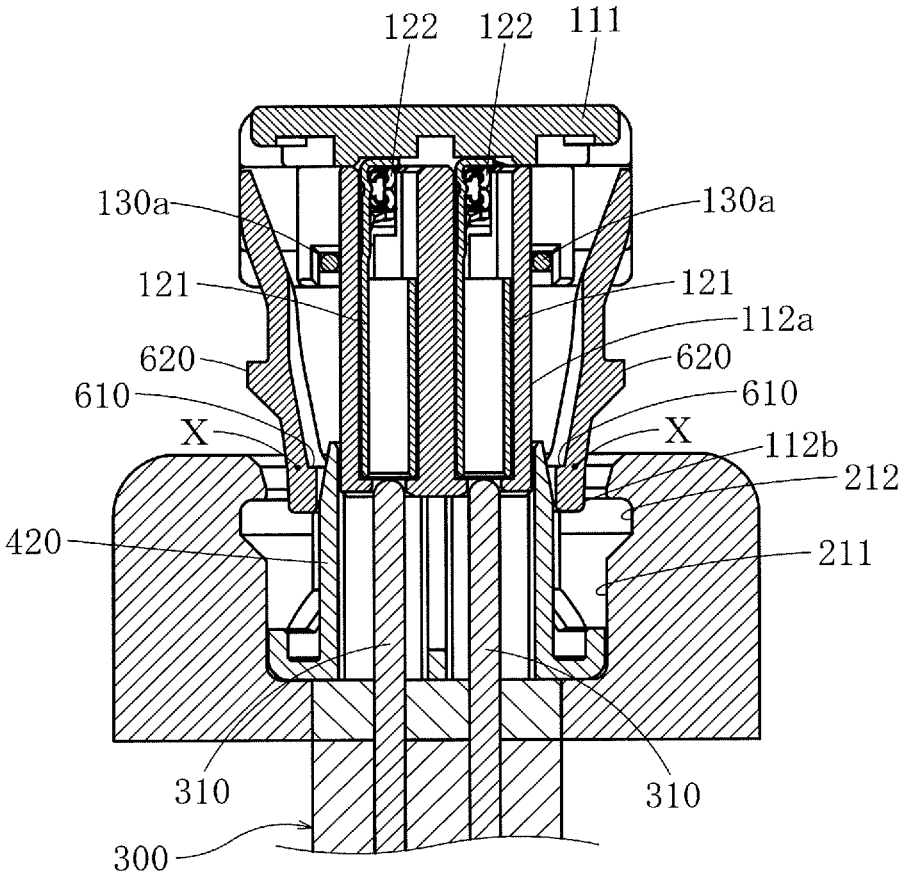
FIG. 7 is a cross-sectional view of the squib connection device and the electrical connector of the embodiment in the state shown in FIG. 6, taken along line C-C in FIG. 5.
Figure 9:
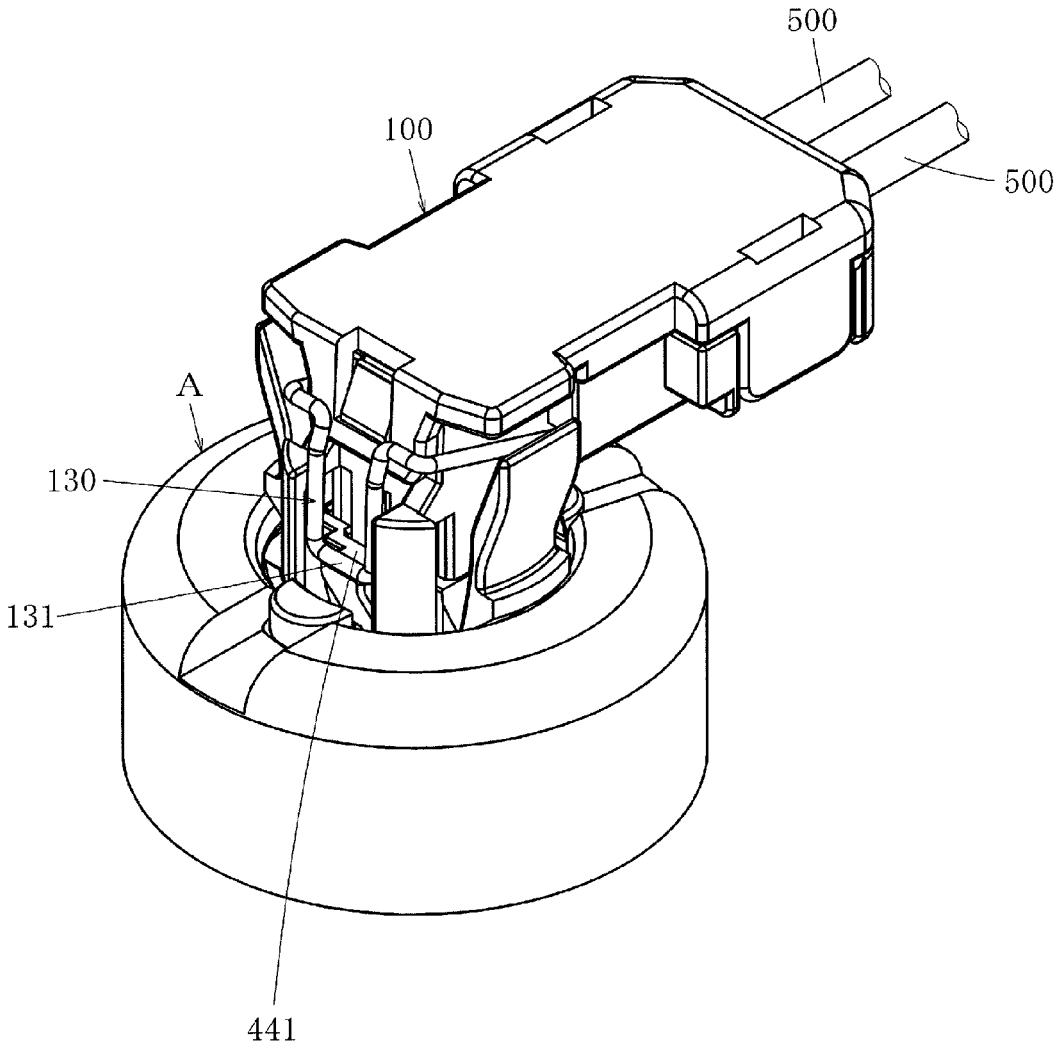
FIG. 9 is a perspective view of the squib connection device of the embodiment and the electrical connector being mated thereto. The depth of insertion of the electrical connector into the squib connection device is greater than in the state shown in FIG. 6.
Figure 10:
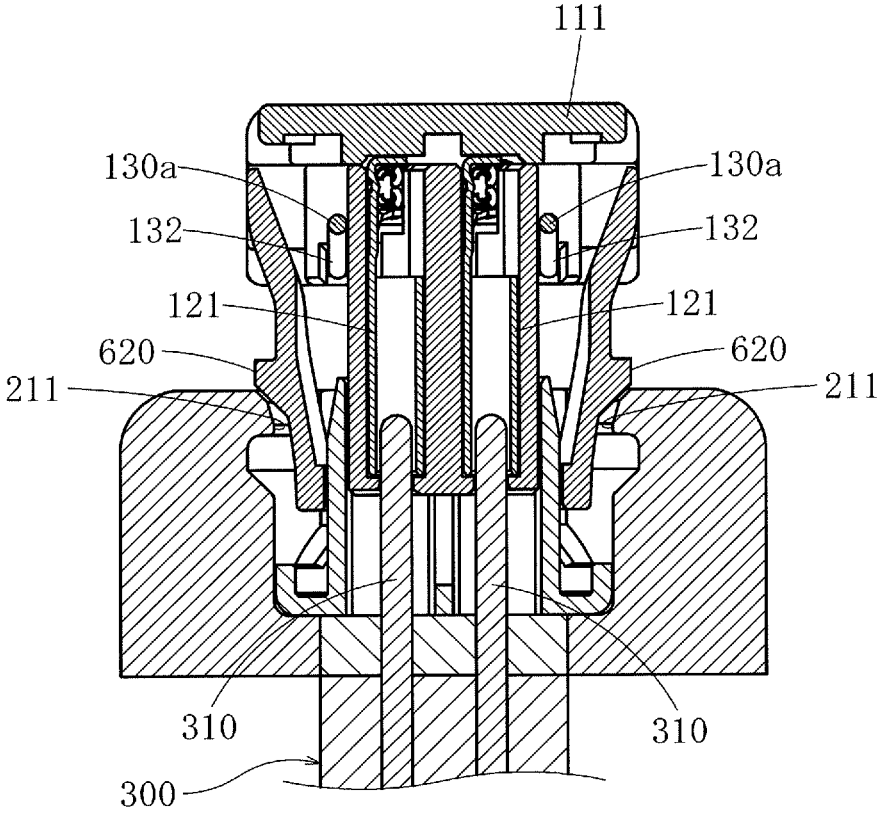
FIG. 10 is a cross-sectional view of the squib connection device and the electrical connector of the embodiment in the state shown in FIG. 9, taken along line C-C in FIG. 5.
Figure 11:
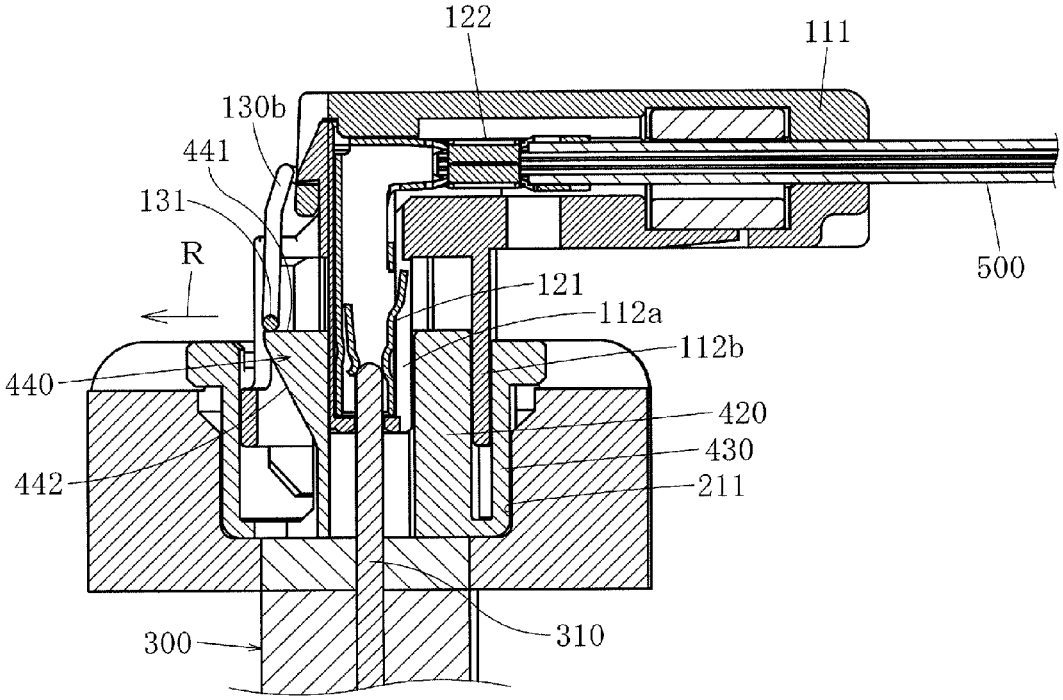
FIG. 11 is a cross-sectional view of the squib connection device and the electrical connector of the embodiment in the state shown in FIG. 9, taken along line D-D in FIG. 5.
Figure 12:
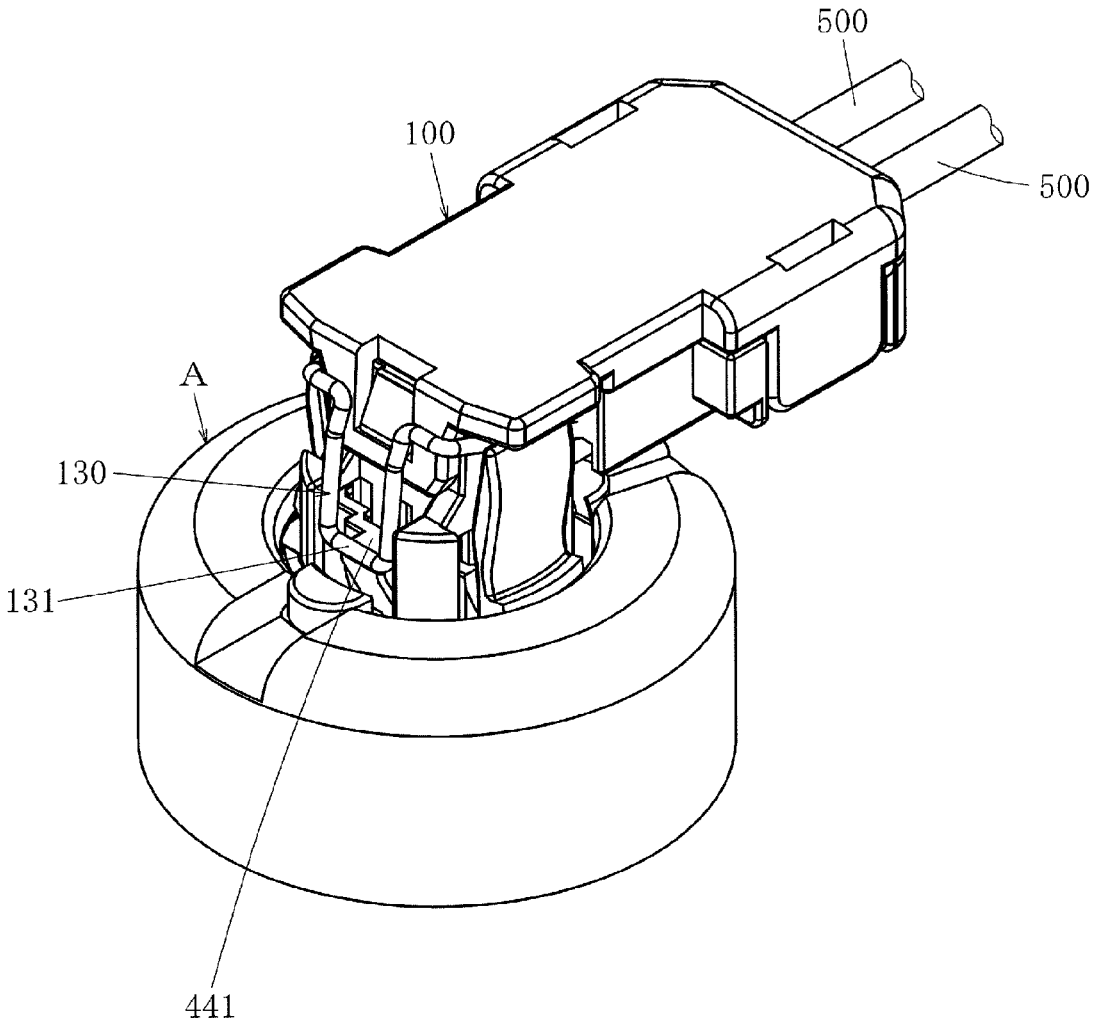
FIG. 12 is a perspective view of the squib connection device of the embodiment and the electrical connector being mated thereto. The depth of insertion of the electrical connector into the squib connection device is greater than in the state shown in FIG. 9.
Figure 13:
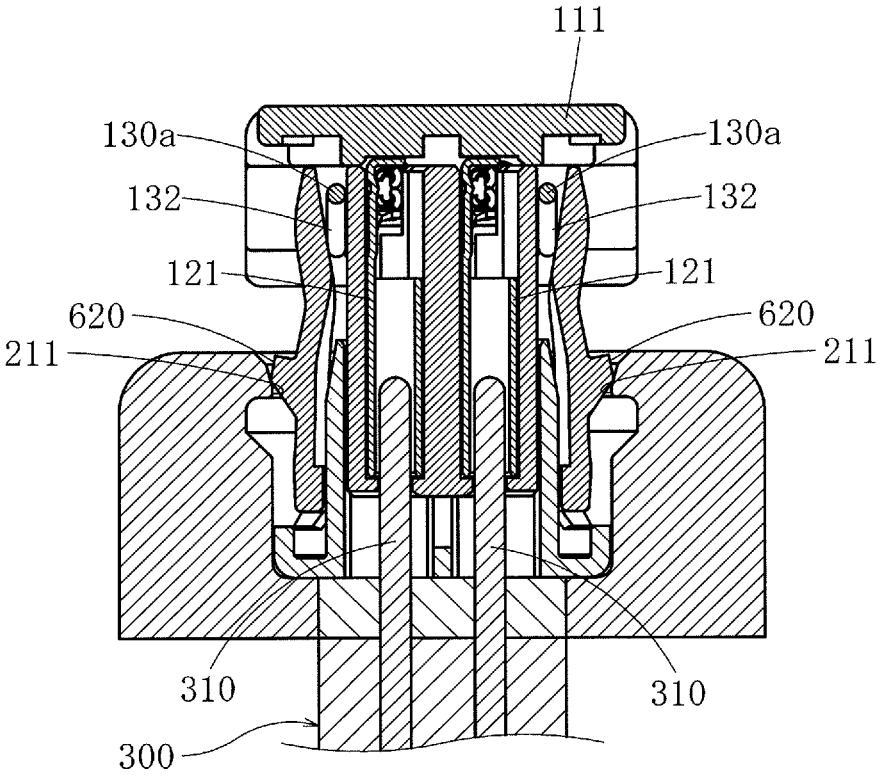
FIG. 13 is a cross-sectional view of the squib connection device and the electrical connector of the embodiment in the state shown in FIG. 12, taken along line C-C in FIG. 5.
Figure 14:
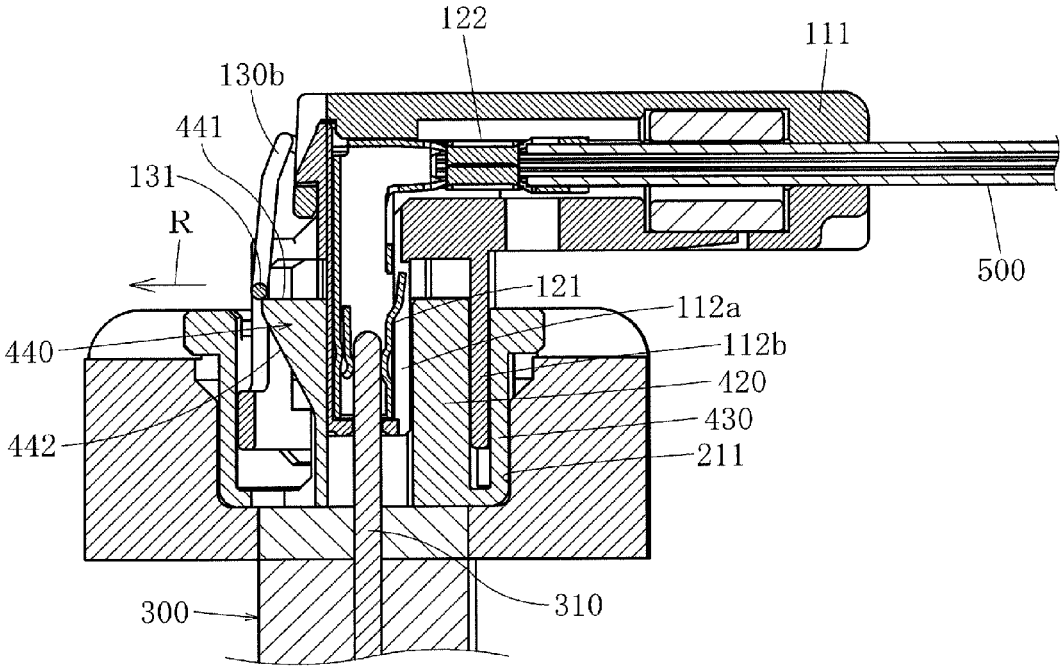
FIG. 14 is a cross-sectional view of the squib connection device and the electrical connector of the embodiment in the state shown in FIG. 12, taken along line D-D in FIG. 5.

For example, in order to move from the state shown in FIGS. 6 to 8 to the state shown in FIGS. 9 to 11 and then to the state shown in FIGS. 12 to 14, the electrical connector 100 is configured such that in a state in which the abutting portion 131 of the support 130 is abutted against the receiving face 441 of the retainer 400 or the inflator housing 200, whose edge descends toward the counter mating side, if the connector housing 110 is pressed toward the mating side and then released before being inserted into the retainer 400 to a predetermined depth, then the connector housing 110 is pressed back in the counter mating direction due to the restoring force generated in the support 130. In order to move to the state shown in FIGS. 15 to 17, if the connector housing 110 is pressed toward the mating side and inserted into the retainer 400 to the predetermined depth, then the abutting portion 131 is displaced in the abutment cancelation direction R so as to separate from the receiving face 441, and thus the connector housing 110 is inserted into the retainer 400 to the predetermined depth or more and mates with the retainer 400, and the electrical terminals 120 come into contact with the squib terminals 310. If the abutting portion 131 becomes displaced in the abutment cancelation direction R so as to separate from the receiving face 441, the abutting portion 131 no longer abuts against the receiving face 441, and therefore the restoring force of the support 130 is freed, and the connector housing 110 is thus inserted into the retainer 400 to the predetermined depth or more. It is preferable that when the abutting portion 131 separates from the receiving face 441, interference of the abutting portion 131 or another portion of the support 130 with the receiving face 441 or the corner portion 440 is avoided. For this reason, in the case of this embodiment, when the abutting portion 131 separates from the receiving face 441, the two second portions 130*b* become located on respective sides of the side face 442 of the corner portion 440 while avoiding it, and when the abutting portion 131 separates from the receiving face 441, then the abutting portion 131 moves in the direction opposite to the abutment cancelation direction R so as to come into contact with or approach the tilted side face 442.

In the state where the abutting portion 131 of the support 130 is abutted against the receiving face 441 of the retainer 400, if the connector housing 110 is not pressed toward the mating side, then the electrical terminals 120 are not in contact with the squib terminals 310. Specifically, as shown in FIGS. 7 and 8, the contact portions 121 of the electrical terminals 120 and the squib terminals 310 are arranged so as to be separated from each other in the state where the abutting portion 131 of the support 130 is abutted against the receiving face 441 of the retainer 400. The contact portions 121 of the electrical terminals 120 then come into contact with the squib terminals 310 when the connector housing 110 is then pressed toward the mating side from this state as shown in FIGS. 10, 11, 13, 14, 16, and 17.

Figure 15:
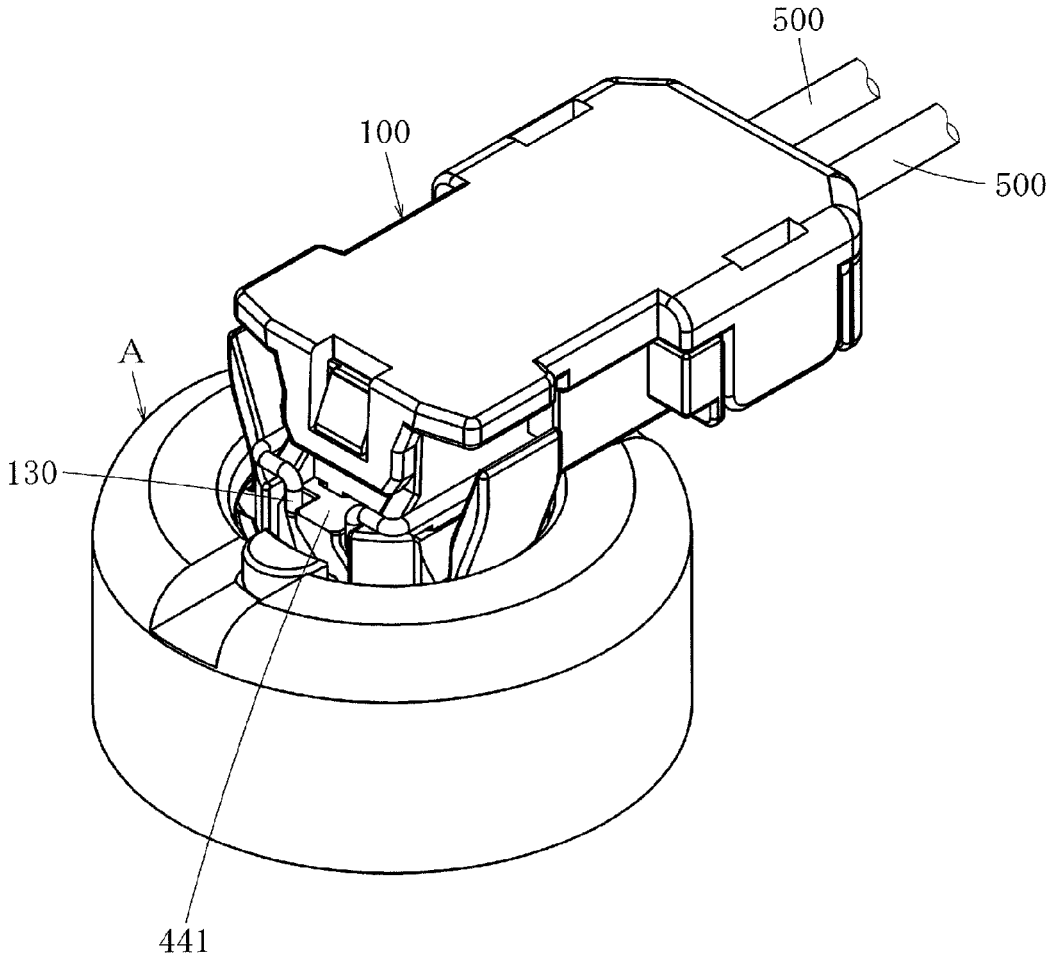
FIG. 15 is a perspective view of the squib connection device of the embodiment and the electrical connector mated thereto. The depth of insertion of the electrical connector into the squib connection device is greater than in the state shown in FIG. 12, and the electrical connector is mated to the squib.
Figure 16:
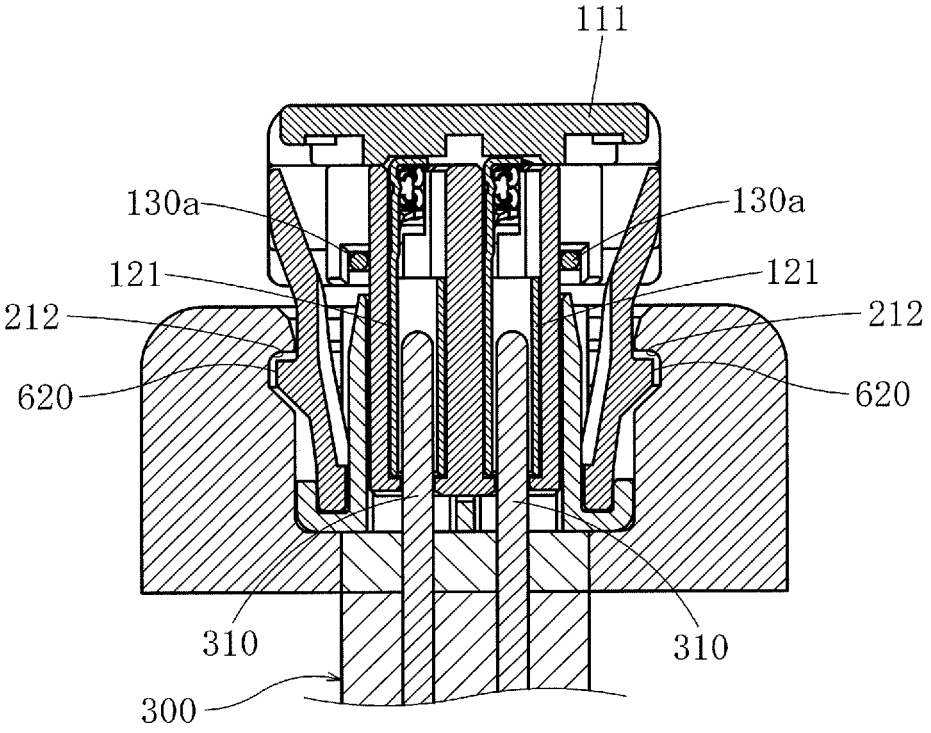
FIG. 16 is a cross-sectional view of the squib connection device and the electrical connector of the embodiment in the state shown in FIG. 15, taken along line C-C in FIG. 5.
Figure 17:
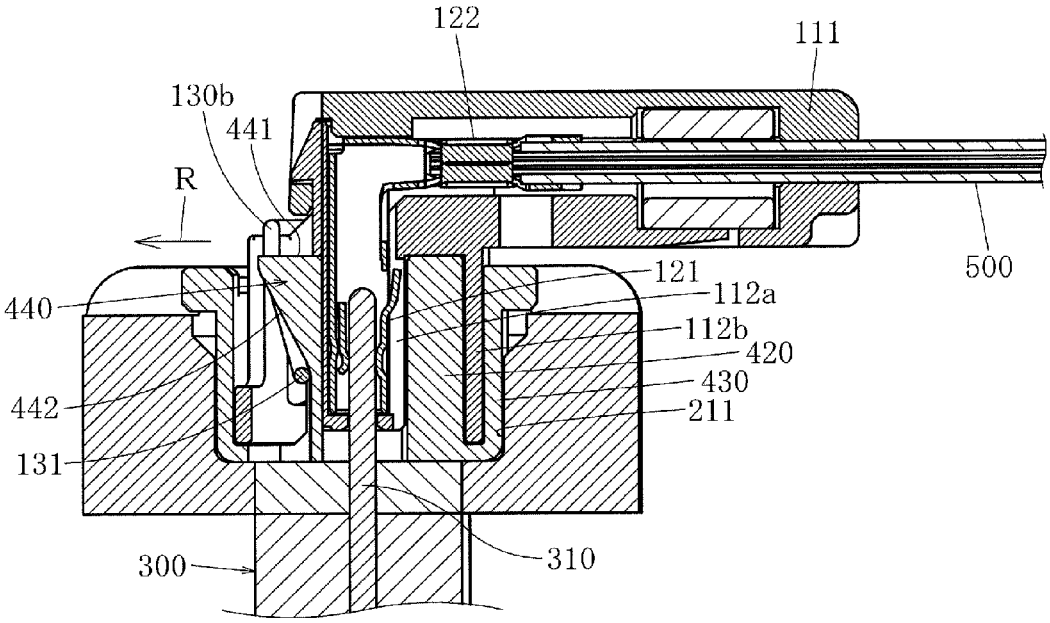
FIG. 17 is a cross-sectional view of the squib connection device and the electrical connector of the embodiment in the state shown in FIG. 15, taken along line D-D in FIG. 5.
Figure 18:
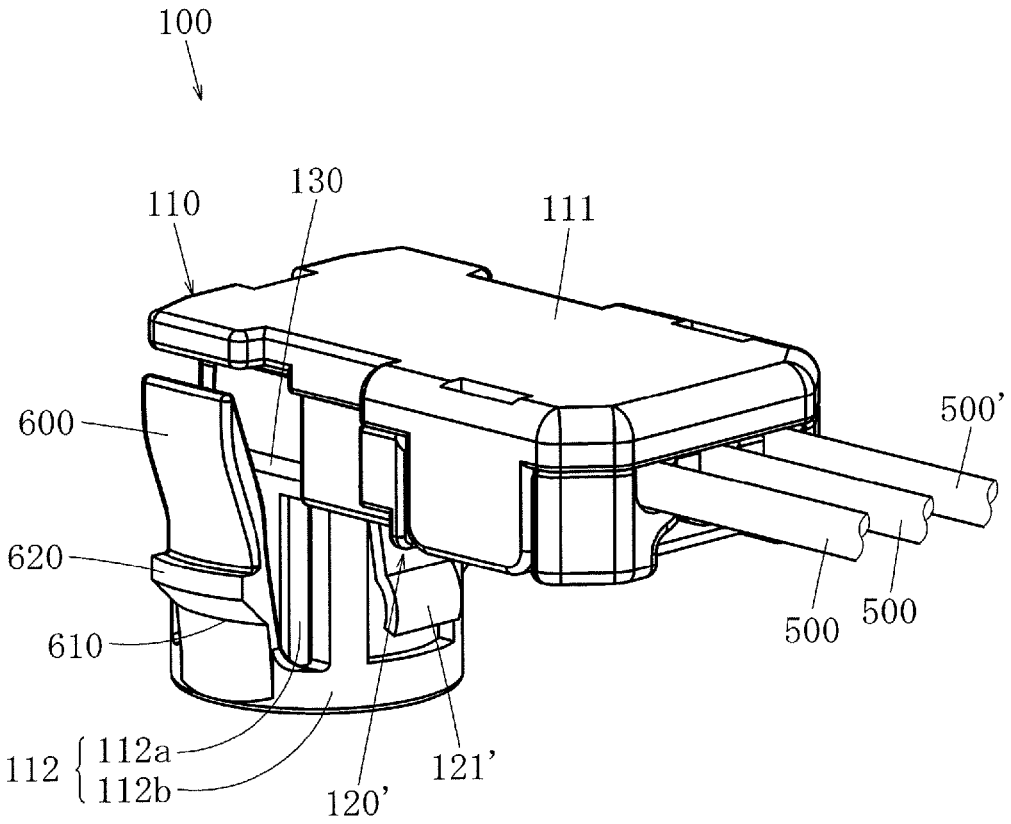
FIG. 18 is a perspective view of an electrical connector according to a variation.

In order to return from the state shown in FIGS. 15 to 17 to the state shown in FIGS. 12 to 14, then to the state shown in FIGS. 9 to 11, and then to the state shown in FIGS. 6 to 8, in the state where the connector housing 110 is mated to the retainer 400, if the connector housing 110 is pulled toward the counter mating side, the abutting portion 131 of the support 130 rides over the edge of the receiving face 441 and then rides over the receiving face 441 and abuts against the receiving face 441 due to the restoring force of the support 130.

As shown in FIGS. 1 to 3 and the like, flexible lock arms 600 extend from the connector housing 110 in the counter mating direction. The lock arms may extend from the connector housing in the mating direction. The lock arms 600 are provided on the housing tube-shaped portion 112*b*, and they may be provided on the mating portion 112 in this way, or may be provided on the housing body. Although two lock arms 600 are provided in this embodiment, one lock arm 600 may be provided, or three or more may be provided. The lock arms 600 are connected to the connector housing 110 via elastically deforming connection portions 610 so as to be able to tilt about an axis X that extends along a direction orthogonal to the mating direction. The axis X is a virtual axis.

Figure 19:
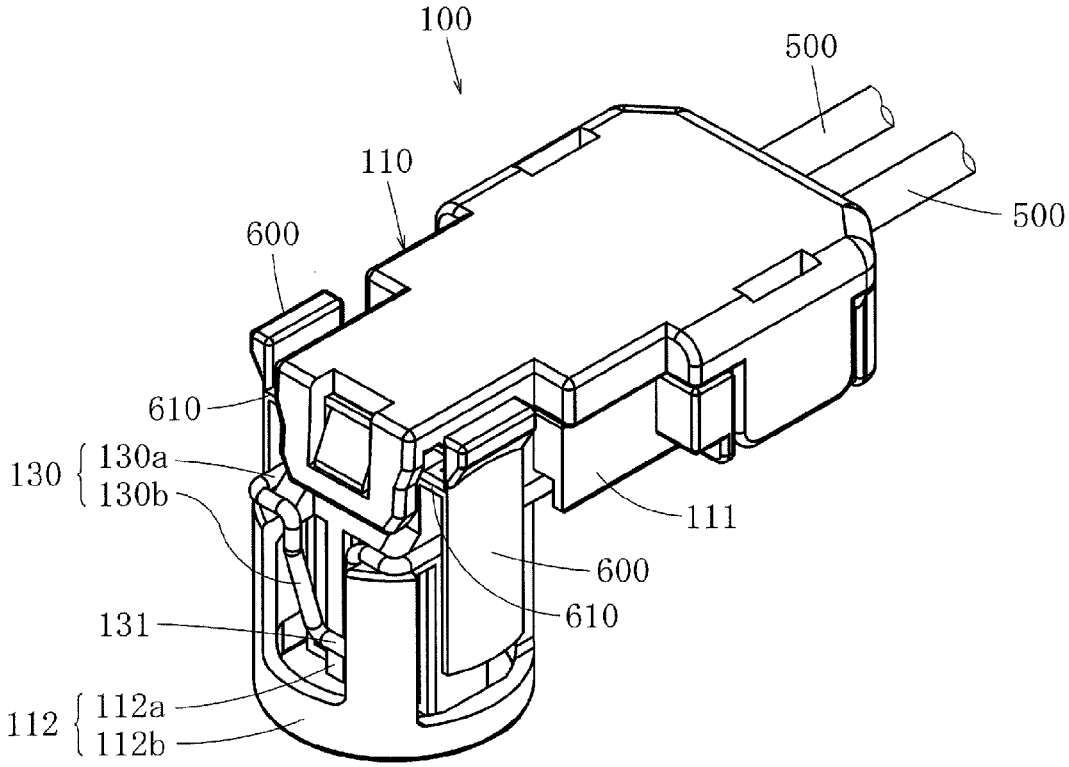
FIG. 19 is a perspective view of an electrical connector according to another variation.
Figure 20:
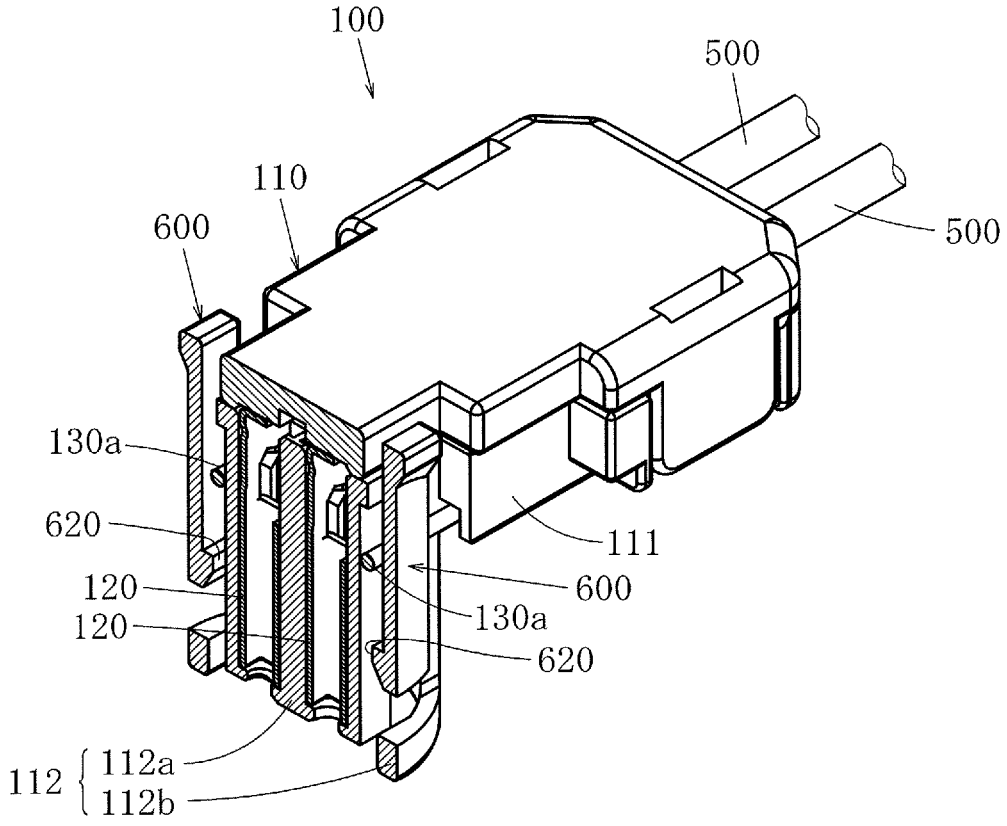
FIG. 20 is a cross-sectional view of the electrical connector according to the other variation.

A projection portion 620 is provided on each of the lock arms 600. The projection portion 620 is provided on a portion of the lock arm 600 that is shifted from a connection portion 610 toward the tip side of the lock arm 600. The projection portion 620 is provided on the outer side of the lock arm 600. When viewing the lock arm 600 in the mating direction, the outer side is the side away from the central portion of the housing body 111, and the inner side is the side opposite to the outer side. As the connector housing 110 is fitted to the retainer 400, that is to say as the mating portion 112 is fitted to the retainer 400, the projection portions 620 ride over the wall 211 of the socket 210 and engage with a step portion of the socket 210, and the projection portions 620 move away from the step portion when the lock arms 600 undergo flexure. In this case, the step portion of the socket 210 is the mating-side edge of the above-described groove 212, for example, but may be formed separately. Then, when the connector housing 110 is mated to the retainer 400, the projection portions 620 engage with the step portion. The mating-side faces of the projection portions 620 of the lock arms 600 are tilted so as to approach the inner side as they extend in the mating direction, and thus the projection portions 620 are smoothly inserted into the step portion, but these faces do not need to be tilted. FIGS. 19 and 20 show a variation of the electrical connector 100. In the case of this electrical connector 100, the projection portions 620 are provided on the inner side of the lock arms 600. As the connector housing 110 is fitted to the retainer 400, that is to say as the mating portion 112 is fitted to the retainer 400, the projection portions 620 ride over the wall of the retainer 400 and engage with a step portion of the retainer 400, and the projection portions 620 move away from the step portion when the lock arms 600 undergo flexure. The step portion of the retainer 400 is the mating-side edge of a recessed portion or hole provided in the retainer 400 for example, but may be formed separately. In the case of this variation, the mating-side faces of the projection portions 620 of the lock arms 600 are tilted so as to approach the outer side as they extend in the mating direction, and thus the projection portions 620 are smoothly inserted into the step portion, but these faces do not need to be tilted. Other aspects of the configuration are similar to the electrical connector of this embodiment.

Accordingly, in a state in which the abutting portion 131 of the support 130 is abutted against the receiving face 441 of the retainer 400 or the inflator housing, if the connector housing 110 is pressed toward the mating side and then released before being inserted into the retainer 400 to the predetermined depth, then the connector housing 110 is pressed back in the counter mating direction due to the restoring force generated in the support 130. In the state where the abutting portion 131 of the support 130 is abutted against the receiving face 441 of the retainer 400 or the inflator housing, if the connector housing 110 is pressed toward the mating side and inserted into the retainer 400 to the predetermined depth, then the abutting portion 131 is displaced in the abutment cancelation direction R so as to separate from the receiving face 441, and thus the connector housing 110 is inserted into the retainer 400 to the predetermined depth or more and mates with the retainer 400, and the electrical terminals 120 come into contact with the squib terminals 310. Accordingly, if the connector housing 110 is at a position of being pushed back in the counter mating direction relative to the retainer 400, the two are not mated. If the connector housing 110 is at a position of having been inserted into the retainer 400 to the predetermined depth or more, the two are mated. Moreover, the connector housing 110 is never located at a position between the above two positions where it is not subjected to pressing force. For this reason, whether or not the electrical connector 100 is mated to the retainer 400 can be checked based on the position of the connector housing 110 relative to the retainer 400, thus easily preventing incomplete mating of the electrical connector 100 to the retainer 400. Also, the retainer 400 has a comparatively simple structure since the retainer 400 does not have members corresponding to the locking arms of the above-described patent document.

When the electrical connector 100 is to be mated to the retainer 400, the connector housing 110 need only be pressed toward the mating side. For this reason, the operator cannot select from various patterns of operational content, such as first pressing the connector housing toward the mating side and then pressing an accessory member such as a lock member toward the mating side, first pressing the accessory member toward the mating side and then pressing the connector housing toward the mating side, or pressing both at the same time. This results in little risk of incomplete mating due to differences in operational content.

Accordingly, when the connector housing 110 is to be mated to the retainer 400, if the connector housing 110 is pressed toward the mating side and then released before being inserted into the retainer 400 to the predetermined depth, then the connector housing 110 is pressed back in the counter mating direction. If the connector housing 110 is pressed toward the mating side and inserted into the retainer 400 to the predetermined depth, then the electrical terminals 120 and the squib terminals 310 become electrically connected due to the connector housing 110 being inserted into the retainer 400 to the predetermined depth or more; thus, making it possible to provide the electrical connector 100 that can prevent incomplete mating, and can have the retainer 400 that has a comparatively simple structure due to eliminating the need to provide the retainer 400 with members corresponding to the lock arms of the above-described patent document.

In the electrical connector of the present invention, it is sufficient that the contact portions of the electrical terminals and the squib terminals are in contact with each other at least when the mating portion of the connector housing has been mated to the retainer, and the contact portions of the electrical terminals and the squib terminals are separated from each other when the mating portion of the connector housing has been separated from the retainer. As one of various embodiments, the electrical connector 100 of the above embodiment and variation is configured such that in the state where the abutting portion 131 of the support 130 is abutted against the receiving face 441, if the connector housing 110 is not pressed toward the mating side, the electrical terminals 120 are not in contact with the squib terminals 310. In this case, the contact portions 121 of the electrical terminals 120 will not be in contact with the squib terminals 310 when the connector housing 110 is pressed back in the counter mating direction by the restoring force generated in the support 130, thus preventing the squibs 300 from inadvertently receiving electrical energy from the electrical connector 100. This also makes it possible to not provide the retainer or the like with the above-described shorting parts. This makes it possible to prevent a situation in which the electrical terminals 120 and the squib terminals 310 are electrically connected to each other regardless of the fact that the mating of the electrical connector 100 to the retainer 400 is incomplete.

The electrical connector of the present invention may be configured such that, for example, a lock portion is provided on the side face of the corner portion, and the support locks to the lock portion when the mating portion of the connector housing is mated to the retainer. In this case, it is necessary to perform the operation of releasing the support from the lock portion when pulling the mating portion of the connector housing out of the retainer. As one of various embodiments, the electrical connector 100 of the above embodiment and variation is configured such that in the state where the connector housing 110 is mated to the retainer 400, if the connector housing 110 is pulled toward the counter mating side, the abutting portion 131 of the support 130 rides over the edge of the receiving face 441 and then rides over the receiving face 441 and abuts against the receiving face 441 due to the restoring force of the support 130. In this case, the electrical connector comes out of the retainer when the connector housing is pulled toward the counter mating side. The above embodiment is preferable since when the side face 442 of the corner portion 440 is provided so as to be tilted so as to approach the abutment cancelation direction R as it extends in the mating direction, the abutting portion 131 is guided by the tilted side face 442 so as to easily ride over the edge of the receiving face 441.

The electrical connector of the present invention includes an embodiment in which the lock arms are not provided. Among various embodiments, the electrical connector 100 of the embodiment and the variation is configured such that the flexible lock arms 600 extend from the connector housing 110 in the counter mating direction or the mating direction, the lock arms 600 are provided with projection portions 620 that, as the connector housing 110 is fitted to the retainer 400, ride over the wall of the socket 210 or the retainer 400 and then engage with the step portion of the socket 210 or the retainer 400, and also move away from the step portion when the lock arms 600 undergo flexure, and the projection portions 620 engage with the step portion when the connector housing 110 is mated to the retainer 400. In this case, when the connector housing 110 is mated to the retainer 400, the projection portions 620 engage with the step portion, thus keeping the state in which the connector housing 110 is mated to the retainer 400.

If the electrical connector of the present invention is provided with the corner portion, the side face may face any direction. Among various embodiments, the side face 442 of the corner portion 440 of the electrical connector 100 of the embodiment and the variation above is tilted so as to approach the abutment cancelation direction R as it extends in the mating direction. In this case, in order to move from the state shown in FIGS. 12 to 14 to the state shown in FIGS. 15 to 17, when the abutting portion 131 becomes displaced in the abutment cancelation direction R so as to separate from the receiving face 441, the abutting portion 131 receives restoring force from the support 130 so as to abut against the side face 442 with pressing force and then move in the mating direction while being guided by the tilted side face 442. Thus, the connector housing 110 is inserted into the retainer 400 to the predetermined depth or more and mated to the retainer 400, and the electrical terminals 120 come into contact with the squib terminals 310. Also, in order to return from the state shown in FIGS. 15 to 17 to the state shown in FIGS. 12 to 14, then to the state shown in FIGS. 9 to 11, and then to the state shown in FIGS. 6 to 8, as the connector housing 110 is separated from the retainer 400, the abutting portion 131 smoothly moves in the counter mating direction while being guided by the tilted side face 442, and the abutting portion 131 abuts against the receiving face 441.

Electrical connectors of this type are sometimes provided with a shorting part. Specifically, a shorting part for shorting the squib terminals is provided in order to prevent, for example, malfunction of the squib due to current or the like flowing between the pair of squib terminals before the electrical connector is mated. In this case, for example, when the electrical connector is mated to the retainer, the shorting terminal is pressed outward and away due to being subject to force from the electrical connector, thus canceling the shorting. Although this shorting part is not provided in the squib connection device of the above-described embodiment, an embodiment of the squib connection device in which the squib connection device of the above-described embodiment includes the shorting part is included as an embodiment of the squib connection device of the present invention.

With the electrical connector 100 of the present invention, the surface of the connector housing 110 on the counter mating side can be formed so as to be substantially flat. This makes it unlikely for problems to occur such as interference between the counter mating side of the connector housing 110 and a harness or the like, and damage to the connector housing 110.

A squib connection device of the present invention is also sufficiently disclosed through the above description. Specifically, a squib connection device of the present invention includes: a partner device A that has an inflator housing 200 provided with a socket 210 that is recessed toward a counter mating side from a surface on a mating side, a squib 300 provided on the counter mating side of the inflator housing 200 such that a squib terminal 310 rises up toward the mating side from a bottom portion of the socket 210, a retainer 400 that is attached to the socket 210, and an electrical connector 100 for mating to the partner device A. The electrical connector 100 includes: a connector housing 110 for mating to the retainer 400; an electrical terminal 120 that is provided in the connector housing 110 and is for coming into contact with the squib terminal 310; and a support 130 that is provided with, on an end portion on the mating side, an abutting portion 131 that is displaced relative to the connector housing 110 in the counter mating direction and an abutment cancelation direction R intersecting a mating direction when pressed in the counter mating direction and generates restoring force due to the displacement of the abutting portion 131, and in a state in which the abutting portion 131 of the support 130 is abutted against a receiving face 441 of the retainer 400 or the inflator housing 200 whose edge descends toward the counter mating side, if the connector housing 110 is pressed toward the mating side and then released before being inserted into the retainer 400 to a predetermined depth, then the connector housing 110 is pressed back in the counter mating direction due to restoring force generated in the support 130. If the connector housing 110 is pressed toward the mating side and inserted into the retainer 400 to the predetermined depth, then the abutting portion 131 becomes displaced in the abutment cancelation direction R so as to separate from the receiving face 441, and thus the connector housing 110 is inserted into the retainer 400 to the predetermined depth or more so as to be mated to the retainer 400, and the electrical terminal 120 becomes connected to the squib terminal 310.

In a state in which the abutting portion 131 of the support 130 is abutted against the receiving face 441 of the retainer 400 or the inflator housing, if the connector housing 110 is pressed toward the mating side and then released before being inserted into the retainer 400 to the predetermined depth, then the connector housing 110 is pressed back in the counter mating direction due to the restoring force generated in the support 130. In the state where the abutting portion 131 of the support 130 is abutted against the receiving face 441 of the retainer 400 or the inflator housing, if the connector housing 110 is pressed toward the mating side and inserted into the retainer 400 to the predetermined depth, then the abutting portion 131 is displaced in the abutment cancelation direction R so as to separate from the receiving face 441, and thus the connector housing 110 is inserted into the retainer 400 to the predetermined depth or more and mates with the retainer 400, and the electrical terminals 120 come into contact with the squib terminals 310. Accordingly, if the connector housing 110 is at a position of being pushed back in the counter mating direction relative to the retainer 400, the two are not mated. If the connector housing 110 is at a position of having been inserted into the retainer 400 to the predetermined depth or more, the two are mated. Moreover, the connector housing 110 is never located at a position between the above two positions where it is not subjected to pressing force. For this reason, whether or not the electrical connector 100 is mated to the retainer 400 can be checked based on the position of the connector housing 110 relative to the retainer 400 thus easily preventing incomplete mating of the electrical connector 100 to the retainer 400. Also, the retainer 400 has a comparatively simple structure since the retainer 400 does not have members corresponding to the locking arms of the above-described patent document.

When the electrical connector 100 is to be mated to the retainer 400, the connector housing 110 need only be pressed toward the mating side. For this reason, the operator cannot select from various patterns of operational content, such as first pressing the connector housing toward the mating side and then pressing an accessory member such as a lock member toward the mating side, first pressing the accessory member toward the mating side and then pressing the connector housing toward the mating side, or pressing both at the same time. This results in little risk of incomplete mating due to differences in operational content.

Accordingly, when the connector housing 110 is to be mated to the retainer 400, if the connector housing 110 is pressed toward the mating side and then released before being inserted into the retainer 400 to the predetermined depth, then the connector housing 110 is pressed back in the counter mating direction. If the connector housing 110 is pressed toward the mating side and inserted into the retainer 400 to the predetermined depth, then the electrical terminals 120 and the squib terminals 310 become electrically connected due to the connector housing 110 being inserted into the retainer 400 to the predetermined depth or more, thus making it possible to provide a squib connection device that can prevent incomplete mating and can have the retainer 400 that has a comparatively simple structure due to eliminating the need to provide the retainer 400 with members corresponding to the lock arms of the above-described patent document.

The following describes another invention related to the electrical connector of the present invention. In the case of the electrical connector of the present invention, the support is provided on the electrical connector. In contrast, in the case of a squib connection device of the aforementioned other invention, the support is provided on the retainer or the inflator housing. Specifically, a squib connection device of the aforementioned other invention includes: a partner device that has an inflator housing provided with a socket that is recessed toward a counter mating side from a surface on a mating side, a squib provided on the counter mating side of the inflator housing such that a squib terminal rises up toward the mating side from a bottom portion of the socket, a retainer that is attached to the socket, and an electrical connector for mating to the partner device. The electrical connector includes: a connector housing for mating to the retainer; and an electrical terminal that is provided in the connector housing and is for coming into contact with the squib terminal. Also, the partner device includes a support that is provided with, on an end portion on the mating side, an abutting portion that is displaced relative to the connector housing in the counter mating direction and an abutment cancelation direction intersecting a mating direction when pressed in the counter mating direction and generates restoring force due to the displacement of the abutting portion. In a state in which the abutting portion of the support is abutted against a receiving face of the connector housing whose edge descends toward the counter mating side, if the connector housing is pressed toward the mating side and then released before being inserted into the retainer to a predetermined depth, then the connector housing is pressed back in the counter mating direction due to restoring force generated in the support. If the connector housing is pressed toward the mating side and inserted into the retainer to the predetermined depth, then the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal. Operations and effects similar to those of the squib connection device of the present invention are achieved by the squib connection device of the aforementioned other invention as well.

An overview of embodiments of the present invention will be described below.

1) A first aspect of an electrical connector of the present invention is an electrical connector for mating to a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket, the electrical connector including:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, wherein in a state in which the abutting portion of the support is abutted against a receiving face of the retainer or the inflator housing whose edge descends toward the counter mating side, if the connector housing is pressed toward the mating side and then released before being inserted into the retainer to a predetermined depth, the connector housing is pressed back in the counter mating direction due to restoring force generated in the support, and if the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

In a state in which the abutting portion of the support is abutted against the receiving face of the retainer or the inflator housing, if the connector housing is pressed toward the mating side and then released before being inserted into the retainer to the predetermined depth, then the connector housing is pressed back in the counter mating direction due to the restoring force generated in the support. In the state where the abutting portion of the support is abutted against the receiving face of the retainer or the inflator housing, if the connector housing is pressed toward the mating side and inserted into the retainer to the predetermined depth, then the abutting portion is displaced in the abutment cancelation direction so as to separate from the receiving face, and thus the connector housing is inserted into the retainer to the predetermined depth or more and mates with the retainer, and the electrical terminals come into contact with the squib terminals. Accordingly, if the connector housing is at a position of being pushed back in the counter mating direction relative to the retainer, the two are not mated. If the connector housing is at a position of having been inserted into the retainer to the predetermined depth or more, the two are mated. Moreover, the connector housing is never located at a position between the above two positions where it is not subjected to pressing force. For this reason, whether or not the electrical connector is mated to the retainer can be checked based on the position of the connector housing relative to the retainer, thus easily preventing incomplete mating of the electrical connector to the retainer. Also, the retainer has a comparatively simple structure since the retainer does not have members corresponding to the locking arms of the above-described patent document.

When the electrical connector is to be mated to the retainer, the connector housing need only be pressed toward the mating side. For this reason, the operator cannot select from various patterns of operational content, such as first pressing the connector housing toward the mating side and then pressing an accessory member such as a lock member toward the mating side, first pressing the accessory member toward the mating side and then pressing the connector housing toward the mating side, or pressing both at the same time. This results in little risk of incomplete mating due to differences in operational content.

According to the electrical connector of the first aspect, when the connector housing is to be mated to the retainer, if the connector housing is pressed toward the mating side and then released before being inserted into the retainer to the predetermined depth, then the connector housing is pressed back in the counter mating direction. If the connector housing is pressed toward the mating side and inserted into the retainer to the predetermined depth, then the electrical terminals and the squib terminals become electrically connected due to the connector housing being inserted into the retainer to the predetermined depth or more, thus making it possible to provide the electrical connector that can prevent incomplete mating, and can have the retainer that has a comparatively simple structure due to eliminating the need to provide the retainer with members corresponding to the lock arms of the above-described patent document.

2) A second aspect of an electrical connector of the present invention is the electrical connector of the first aspect, wherein in a state where the abutting portion of the support is abutted against the receiving face, if the connector housing is not pressed toward the mating side, then the electrical terminal is not in contact with the squib terminal.

According to this configuration, the contact portions of the electrical terminals will not be in contact with the squib terminals when the connector housing is pressed back in the counter mating direction by the restoring force generated in the support, thus preventing the squibs from inadvertently receiving electrical energy from the electrical connector. This also makes it possible to not provide the retainer or the like with the above-described shorting parts.

The electrical connector of the second aspect obtains the effects obtained by the electrical connector of the first aspect, and additionally can prevent a situation in which the electrical terminal and the squib terminal are electrically connected to each other regardless of the fact that the mating of the electrical connector and the retainer is incomplete.

3) A third aspect of an electrical connector of the present invention is the electrical connector of the first aspect or the electrical connector of the second aspect, wherein in a state where the connector housing is mated to the retainer, if the connector housing is pulled toward the counter mating side, the abutting portion of the support rides over the edge of the receiving face and then rides over the receiving face and abuts against the receiving face due to restoring force of the support.

According to this configuration, the electrical connector comes out of the retainer when the connector housing is pulled toward the counter mating side.

The electrical connector of the third aspect obtains the effects obtained by the electrical connector of the first or second aspect, and additionally makes it possible to pull the electrical connector out of the retainer by moving the connector housing toward the counter mating side.

4) A fourth aspect of an electrical connector of the present invention is the electrical connector of any one of the first to third aspects, wherein a flexible lock arm extends from the connector housing in the counter mating direction or the mating direction, the lock arm is provided with a projection portion that, as the connector housing is fitted to the retainer, rides over a wall of the socket or the retainer and engages with a step portion of the socket or the retainer, and that moves away from the step portion when the lock arm undergoes flexure, and when the connector housing is mated to the retainer, the projection portion engages with the step portion.

According to this configuration, when the connector housing is mated to the retainer, the projection portions engage with the step portion, thus keeping the state in which the connector housing is mated to the retainer.

The electrical connector of the fourth aspect obtains the effects obtained by the electrical connector of any one of the first to third aspects, and additionally when the connector housing is mated to the retainer, the projection portion engages with the step portion, thus making it possible to keep the state in which the connector housing is mated to the retainer.

5) One aspect of a squib connection device of the present invention is a squib connection device including: a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector for mating to the partner device, wherein the electrical connector includes:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, and in a state in which the abutting portion of the support is abutted against a receiving face of the retainer or the inflator housing whose edge descends toward the counter mating side, if the connector housing is pressed toward the mating side and then released before being inserted into the retainer to a predetermined depth, then the connector housing is pressed back in the counter mating direction due to restoring force generated in the support. If the connector housing is pressed toward the mating side and inserted into the retainer to the predetermined depth, then the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

In a state in which the abutting portion of the support is abutted against the receiving face of the retainer or the inflator housing, if the connector housing is pressed toward the mating side and then released before being inserted into the retainer to the predetermined depth, then the connector housing is pressed back in the counter mating direction due to the restoring force generated in the support. In the state where the abutting portion of the support is abutted against the receiving face of the retainer or the inflator housing, if the connector housing is pressed toward the mating side and inserted into the retainer to the predetermined depth, then the abutting portion is displaced in the abutment cancelation direction so as to separate from the receiving face, and thus the connector housing is inserted into the retainer to the predetermined depth or more and mates with the retainer, and the electrical terminals come into contact with the squib terminals. Accordingly, if the connector housing is at a position of being pushed back in the counter mating direction relative to the retainer, the two are not mated. If the connector housing is at a position of having been inserted into the retainer to the predetermined depth or more, the two are mated. Moreover, the connector housing is never located at a position between the above two positions where it is not subjected to pressing force. For this reason, whether or not the electrical connector is mated to the retainer can be checked based on the position of the connector housing relative to the retainer, thus easily preventing incomplete mating of the electrical connector to the retainer. Also, the retainer has a comparatively simple structure since the retainer does not have members corresponding to the locking arms of the above-described patent document.

When the electrical connector is to be mated to the retainer, the connector housing need only be pressed toward the mating side. For this reason, the operator cannot select from various patterns of operational content, such as first pressing the connector housing toward the mating side and then pressing an accessory member such as a lock member toward the mating side, first pressing the accessory member toward the mating side and then pressing the connector housing toward the mating side, or pressing both at the same time. This results in little risk of incomplete mating due to differences in operational content.

According to the squib connection device of this aspect, when the connector housing is to be mated to the retainer, if the connector housing is pressed toward the mating side and then released before being inserted into the retainer to the predetermined depth, then the connector housing is pressed back in the counter mating direction. If the connector housing is pressed toward the mating side and inserted into the retainer to the predetermined depth, the electrical terminals and the squib terminals become electrically connected due to the connector housing being inserted into the retainer to the predetermined depth or more, thus making it possible to provide the squib connection device that can prevent incomplete mating, and can have the retainer that has a comparatively simple structure due to eliminating the need to provide the retainer with members corresponding to the lock arms of the above-described patent document.

The electrical connector and the squib connection device of the present invention encompass embodiments that are combinations of features of the above-described embodiment and variations. Furthermore, the above-described embodiment and variations are merely several examples of the electrical connector and the squib connection device of the present invention. Accordingly, the electrical connector and the squib connection device of the present invention are not intended to be limited by the descriptions of the embodiment and variations.

The disclosure of Japanese Patent Application No. 2013-138466 filed on Jul. 1, 2013 including specification, drawings and claims is incorporated herein by reference in its entirety.

The invention claimed is:

1. An electrical connector for mating to a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket, the electrical connector comprising:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, wherein in a state in which the abutting portion of the support is abutted against a receiving face of the retainer or the inflator housing whose edge descends toward the counter mating side, if the connector housing is pressed toward the mating side and then released before being inserted into the retainer to a predetermined depth, the connector housing is pressed back in the counter mating direction due to restoring force generated in the support, and if the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

2. The electrical connector according to claim 1, wherein a flexible lock arm extends from the connector housing in the counter mating direction or the mating direction, wherein the lock arm is provided with a projection portion that, as the connector housing is fitted to the retainer, rides over a wall of the socket or the retainer and then engages with a step portion of the socket or the retainer, and that moves away from the step portion when the lock arm undergoes flexure, and wherein when the connector housing is mated to the retainer, the projection portion engages with the step portion.

3. The electrical connector according to claim 1, wherein in a state where the connector housing is mated to the retainer, if the connector housing is pulled toward the counter mating side, the abutting portion of the support rides over the edge of the receiving face and then rides over the receiving face and abuts against the receiving face due to restoring force of the support.

4. The electrical connector according to claim 3, wherein a flexible lock arm extends from the connector housing in the counter mating direction or the mating direction, wherein the lock arm is provided with a projection portion that, as the connector housing is fitted to the retainer, rides over a wall of the socket or the retainer and then engages with a step portion of the socket or the retainer, and that moves away from the step portion when the lock arm undergoes flexure, and wherein when the connector housing is mated to the retainer, the projection portion engages with the step portion.

5. The electrical connector according to claim 1, wherein in a state where the abutting portion of the support is abutted against the receiving face, if the connector housing is not pressed toward the mating side, the electrical terminal is not in contact with the squib terminal.

6. The electrical connector according to claim 5, wherein in a state where the connector housing is mated to the retainer, if the connector housing is pulled toward the counter mating side, the abutting portion of the support rides over the edge of the receiving face and then rides over the receiving face and abuts against the receiving face due to restoring force of the support.

7. The electrical connector according to claim 6, wherein a flexible lock arm extends from the connector housing in the counter mating direction or the mating direction, wherein the lock arm is provided with a projection portion that, as the connector housing is fitted to the retainer, rides over a wall of the socket or the retainer and then engages with a step portion of the socket or the retainer, and that moves away from the step portion when the lock arm undergoes flexure, and wherein when the connector housing is mated to the retainer, the projection portion engages with the step portion.

8. The electrical connector according to claim 5, wherein a flexible lock arm extends from the connector housing in the counter mating direction or the mating direction, wherein the lock arm is provided with a projection portion that, as the connector housing is fitted to the retainer, rides over a wall of the socket or the retainer and then engages with a step portion of the socket or the retainer, and that moves away from the step portion when the lock arm undergoes flexure, and wherein when the connector housing is mated to the retainer, the projection portion engages with the step portion.

9. A squib connection device comprising:

a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector for mating to the partner device, wherein the electrical connector comprises:

a connector housing for mating to the retainer;

an electrical terminal that is provided in the connector housing and is for coming into contact with the squib terminal; and a support that is provided with, on an end portion on the mating side, an abutting portion that is displaced relative to the connector housing in the counter mating direction and an abutment cancelation direction intersecting a mating direction when pressed in the counter mating direction, and generates restoring force due to the displacement of the abutting portion, and in a state in which the abutting portion of the support is abutted against a receiving face of the retainer or the inflator housing whose edge descends toward the counter mating side, if the connector housing is pressed toward the mating side and then released before being inserted into the retainer to a predetermined depth, the connector housing is pressed back in the counter mating direction due to restoring force generated in the support, and if the connector housing is pressed toward the mating side and inserted into the retainer to the predetermined depth, the abutting portion becomes displaced in the abutment cancelation direction so as to separate from the receiving face, and thus the connector housing is inserted into the retainer to the predetermined depth or more so as to be mated to the retainer, and the electrical terminal becomes connected to the squib terminal.

* * * * *